US011482801B2

(12) United States Patent
Tsuchiya et al.

(10) Patent No.: US 11,482,801 B2
(45) Date of Patent: Oct. 25, 2022

(54) ELECTRIC CONNECTOR AND METHOD FOR MANUFACTURING THE SAME

(71) Applicant: Shin-Etsu Polymer Co., Ltd., Tokyo (JP)

(72) Inventors: Masatoshi Tsuchiya, Shiojiri (JP); Atsuya Shimizu, Shiojiri (JP)

(73) Assignee: SHIN-ETSU POLYMER CO., LTD., Tokyo (JP)

( * ) Notice: Subject to any disclaimer, the term of this patent is extended or adjusted under 35 U.S.C. 154(b) by 57 days.

(21) Appl. No.: 16/754,747

(22) PCT Filed: Oct. 18, 2018

(86) PCT No.: PCT/JP2018/038827
§ 371 (c)(1),
(2) Date: Apr. 9, 2020

(87) PCT Pub. No.: WO2019/078295
PCT Pub. Date: Apr. 25, 2019

(65) Prior Publication Data

US 2020/0321144 A1 Oct. 8, 2020

(30) Foreign Application Priority Data

Oct. 19, 2017 (JP) ..... JP2017-202475

(51) Int. Cl.
*H01R 11/01* (2006.01)
*H01B 1/22* (2006.01)
(Continued)

(52) U.S. Cl.
CPC ..... *H01R 11/01* (2013.01); *H01B 1/22* (2013.01); *H01B 5/14* (2013.01); *H01B 5/16* (2013.01);
(Continued)

(58) Field of Classification Search
None
See application file for complete search history.

(56) References Cited

U.S. PATENT DOCUMENTS 5,500,280 A * 3/1996 Yamazaki ..... H01R 13/2414 428/220
2001/0013661 A1* 8/2001 Yamaguchi ..... H01L 24/81 257/778
2005/0173731 A1* 8/2005 Hasegawa ..... H01R 43/007 257/200

FOREIGN PATENT DOCUMENTS

JP H6-251848 A 9/1994
JP 2002-8749 A 1/2002
(Continued)

OTHER PUBLICATIONS

International Search Report in PCT Application No. PCT/JP2018/038827, dated Dec. 25, 2018, 4pp.

*Primary Examiner* — Katie L. Hammer
(74) *Attorney, Agent, or Firm* — Hauptman Ham, LLP

(57) ABSTRACT

An electric connector is disposed between a connection terminal of a first device and a connection terminal of a second device, and electrically connects these connection terminals. The electric connector includes a resin layer, and a plurality of metal wires extending through the resin layer in a thickness direction, and having a rectangular shape on surfaces to be connected to the connection terminals. At least first sides of the rectangular shapes of the metal wires are arranged at equal intervals along the same direction. The length of short sides of the rectangular shapes are less than 5 μm.

6 Claims, 15 Drawing Sheets

(51) Int. Cl.

| | |
|---|---|
| ***H01B 5/14*** | (2006.01) |
| ***H01B 5/16*** | (2006.01) |
| ***H01B 13/00*** | (2006.01) |
| ***H01B 7/22*** | (2006.01) |
| ***H01R 13/405*** | (2006.01) |
| ***H01R 43/00*** | (2006.01) |

(52) U.S. Cl.
CPC ..... *H01B 7/221* (2013.01); *H01B 13/0013* (2013.01); *H01B 13/0016* (2013.01); *H01B 13/0036* (2013.01); *H01B 13/00* (2013.01); *H01R 13/405* (2013.01); *H01R 43/00* (2013.01)

(56) References Cited

FOREIGN PATENT DOCUMENTS

| | | | |
|---|---|---|---|
| JP | 2009-289730 | A | 12/2009 |
| WO | 03/079497 | A1 | 9/2003 |

* cited by examiner

ELECTRIC CONNECTOR AND METHOD FOR MANUFACTURING THE SAME

RELATED APPLICATIONS

The present application is a National Phase of international Application Number PCT/JP2018/038827, filed Oct. 18, 2018, and claims priority based on Japanese Patent Application No. 2017-202475, filed Oct. 19, 2017.

FIELD

The present invention relates to an electric connector and a method for manufacturing the same. This application is based upon and claims the benefit of priority from Japanese Patent Application No. 2017-202475, filed on Oct. 19, 2017, the entire content of which is incorporated herein by reference.

BACKGROUND

A conventional electric connector used for connecting electric/electronic components has a structure in which a plurality of metal wires covered by a precious metal are arranged at substantially equal intervals in the length and the width directions of the plane of a silicone-rubber insulating sheet. The metal wires diagonally extend through the silicone-rubber insulating sheet in the thickness direction (see Patent Literature 1, for example).

Also known is an electric connector that is provided with metal ribbons, instead of metal wires, having a linear shape and a thickness of 0.02 mm to 0.1 mm, having an aspect ratio (thickness/width) set to a range between 0.2 to 0.6, and arranged in a manner inclined with respect to the surface, by an angle between 45 degrees and 85 degrees (see Patent Literature 2, for example).

CITATION LIST

Patent Literature

Patent Literature 1: Japanese Patent Application Laid-open No. H6-251848

Patent Literature 2: Japanese Patent Application Laid-open No. 2002-008749

SUMMARY

Technical Problem

In the electric connector disclosed in Patent Literature 1, the metal wires are relatively rigid, because the metal wires have a diameter between 10 μm to 50 μm. A load at a certain level or higher is required to achieve an electrically stable contact between the metal wires and the electrodes to be inspected. If an excessive load is applied, however, the electrodes may be damaged by the metal wires. Even if the metal wires are disposed diagonally to give some spring characteristics to the metal wires, with an intention to avoid application of excessive load, in an attempt to address the issue, while ensuring electrically stable contact between the metal wires and the electrodes to be inspected, it is difficult to completely eliminate damage of the electrodes to be inspected. Moreover, as the sizes of devices are reduced, the area of the electrodes to be inspected and the pitch between the electrodes decrease, and electric connectors with a conventional metal-wire sizes fail to achieve such size reductions.

Furthermore, it is still difficult for the electric connector disclosed in Patent Literature 2, which uses the metal ribbons as described earlier, to completely eliminate damage of the electrodes to be inspected, and to achieve such size reductions of the device.

The present invention is made in consideration of the situation described above, and an object of the present invention is to provide an electric connector and a method for manufacturing the same capable of suppressing damage of the electrodes to be inspected, and achieving a reduction in the pitch size and an increased density.

Solution to Problem

[1] An electric connector that is disposed between a connection terminal of a first device and a connection terminal of a second device, and is configured to electrically connect the connection terminals, the electric connecter including: a resin layer; and a plurality of metal wires extending through the resin layer in a thickness direction, and each having a rectangular shape on surfaces to be connected to the connection terminals, in which at least first sides of the rectangular shapes of the metal wires are arranged at equal intervals along a same direction, and short sides of the rectangular shapes have a length of less than 5 μm.

[2] The electric connector according to [1], in which long sides of the rectangular shapes have a length of equal to or less than 150 μm.

[3] The electric connector according to [1] or [2], in which the metal wires have a pitch, in a long-side direction of the rectangular shapes, of equal to or less than 0.2 mm.

[4] The electric connector according to any one of [1] to [3], in which the metal wires have a pitch, in a short-side direction of the rectangular shapes, of equal to or less than 0.2 mm.

[5] The electric connector according to any one of [1] to [4], in which the metal wires extend through the resin layer diagonally with respect to the thickness direction.

[6] The electric connector according to any one of [1] to [5], in which ends of the metal wires project from at least one of one principal surface and another principal surface of the resin layer.

[7] The electric connector according to any one of [1] to [6], in which a plating layer is formed on ends of the metal wires.

[8] A method for manufacturing an electric connector, the method including: providing a plating layer on one surface of a base material; providing a plurality of metal wires that are arranged at equal intervals along a same direction, by laser-machining the plating layer; providing a first rubber sheet by bonding one surface of a first uncured rubber sheet onto the metal wires provided on the one surface of the base material, and then vulcanizing the first uncured rubber sheet; removing the base material so that the metal wires are left on the one surface of the first rubber sheet; forming an elastic body including the first rubber sheet, the metal wires, and a second rubber sheet, with the second rubber sheet being formed by bonding a second uncured rubber sheet onto the one surface of the first rubber sheet in a manner covering the metal wires, and then vulcanizing the second uncured rubber sheet; forming a laminate by laminating a plurality of the elastic bodies in such a manner that the metal wires are positioned in parallel with one another; and cutting the laminate perpendicularly or diagonally to an extending direction of the metal wires.

[9] A method for manufacturing an electric connector, the method including: providing a plating layer on one surface of a base material; providing a first rubber sheet by bonding one surface of a first uncured rubber sheet onto the plating layer provided on the one surface of the base material, and then vulcanizing the first uncured rubber sheet; removing the base material so that the plating layer is left on one surface of the first rubber sheet; providing a plurality of metal wires that are arranged at equal intervals along a same direction, by laser-machining the plating layer; forming an elastic body including the first rubber sheet, the metal wires, and a second rubber sheet, with the second rubber sheet being formed by bonding one surface of a second uncured rubber sheet onto the one surface of the first rubber sheet in a manner covering the metal wires, and then vulcanizing the second uncured rubber sheet; forming a laminate by laminating a plurality of the elastic bodies in such a manner that the metal wires are positioned in parallel with one another; and cutting the laminate perpendicularly or diagonally to an extending direction of the metal wires.

[10] A method for manufacturing an electric connector, the method including: providing a plurality of metal wires that are arranged at equal intervals along a same direction, by applying metal nano-paste onto one surface of a base material; providing a first rubber sheet by bonding one surface of a first uncured rubber sheet onto the metal wires provided on the one surface of the base material, and then vulcanizing the first uncured rubber sheet; removing the base material so that the metal wires are left on one surface of the first rubber sheet; forming an elastic body including the first rubber sheet, the metal wires, and a second rubber sheet, with the second rubber sheet being formed by bonding one surface of a second uncured rubber sheet onto the one surface of the first rubber sheet in a manner covering the metal wires, and then vulcanizing the second uncured rubber sheet; forming a laminate by laminating a plurality of the elastic bodies in such a manner that the metal wires are positioned in parallel with one another; and cutting the laminate perpendicularly or diagonally to an extending direction of the metal wires.

[11] A method for manufacturing an electric connector, the method including: applying liquid silicone rubber onto one surface of a silicon wafer mold that is a silicon wafer, the one surface being provided with a plurality of band-like grooves arranged at equal intervals along a same direction, and the liquid silicone rubber being applied in such a manner that the liquid silicone rubber gets inside of the grooves, and then vulcanizing the liquid silicone rubber, to obtain a silicone rubber mold having a plurality of protrusions and recesses corresponding to the grooves; providing precursors of a plurality of metal wires by applying metal nano-paste onto the protrusions of the silicone rubber mold; bonding one surface of a first uncured rubber sheet onto the precursors of the metal wires formed on the protrusions of the silicone rubber mold, and then transferring the precursors of the metal wires onto the one surface of the first uncured rubber sheet; providing a first rubber sheet by vulcanizing the first uncured rubber sheet, and then forming the metal wires that are arranged at equal intervals along a same direction on one surface of the first rubber sheet, by firing the precursors of the metal wires; forming an elastic body including the first rubber sheet, the metal wires, and a second rubber sheet, with the second rubber sheet being formed by bonding one surface of a second uncured rubber sheet onto the one surface of the first rubber sheet in a manner covering the metal wires, and then vulcanizing the second uncured rubber sheet; forming a laminate by laminating a plurality of the elastic bodies in such a manner that the metal wires are positioned in parallel with one another; and cutting the laminate perpendicularly or diagonally to an extending direction of the metal wires.

[12] A method for manufacturing an electric connector, the method including: providing a plurality of metal wires that are arranged at equal intervals along a same direction, by using a base material having a line-and-space resist pattern including band-like grooves that are arranged at equal intervals along a same direction, on one surface of the base material to form a plating layer in the grooves where the one surface of the base material is exposed; removing the resist pattern provided on the one surface of the base material; providing a first rubber sheet by bonding one surface of a first uncured rubber sheet onto the metal wires provided on the one surface of the base material, and then vulcanizing the first uncured rubber sheet; removing the base material so that the metal wires are left on one surface of the first rubber sheet; forming a laminate by laminating a plurality of the first rubber sheets, with an adhesive interposed therebetween, in such a manner that the metal wires are positioned in parallel with one another; and cutting the laminate perpendicularly or diagonally to an extending direction of the metal wires.

Advantageous Effects of Invention

According to the present invention, it is possible to provide an electric connector and a method for manufacturing the same capable of suppressing damage of the electrodes to be inspected, and achieving a reduction in the pitch size and an increased density.

BRIEF DESCRIPTION OF DRAWINGS

FIG. 1A is a plan view, and FIG. 1B is a sectional view along line A-A in FIG. 1A.

DESCRIPTION OF EMBODIMENTS

Some embodiments of an electric connector and a method for manufacturing the same according to the present invention will now be explained.

The embodiments will be explained specifically to facilitate better understanding of the essence of the present invention, and therefore, are not intended to limit the scope of the present invention in any way, unless specified otherwise.

First Embodiment

[Electric Connector]

Figure 1A:
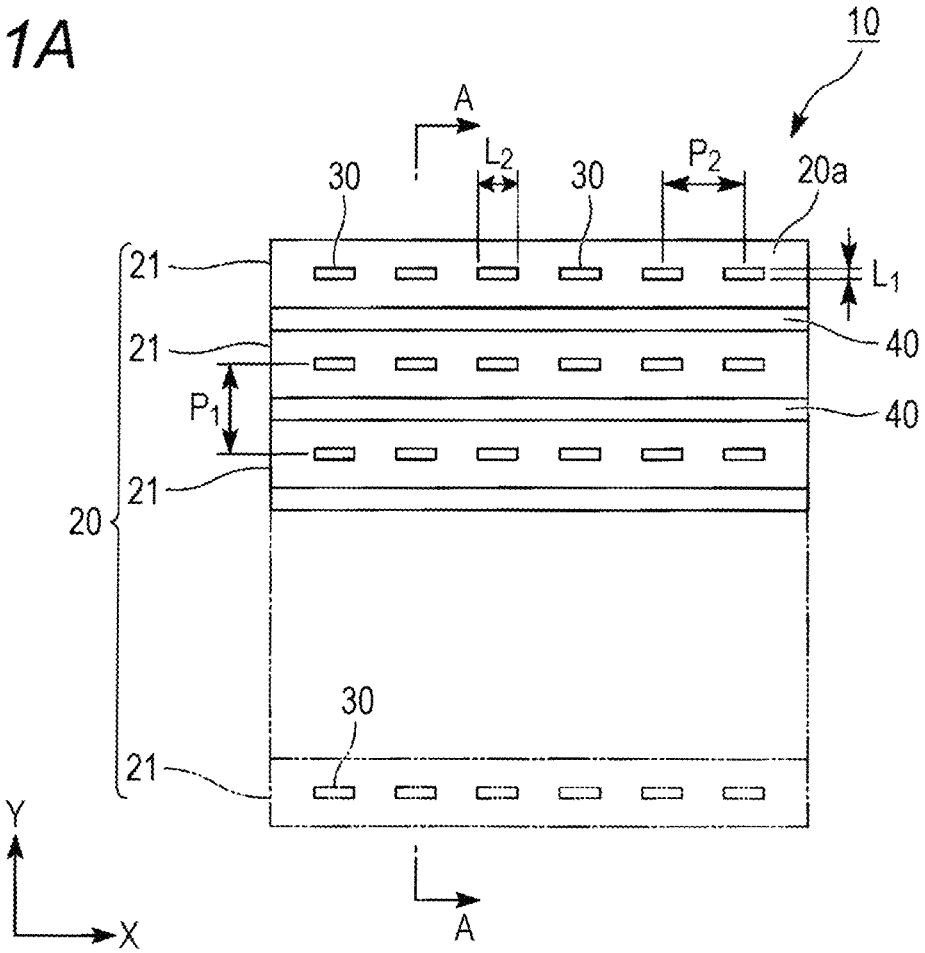
FIGS. 1A to 1B illustrate schematic configurations of an electric connector according to a first embodiment, where
Figure 1B:
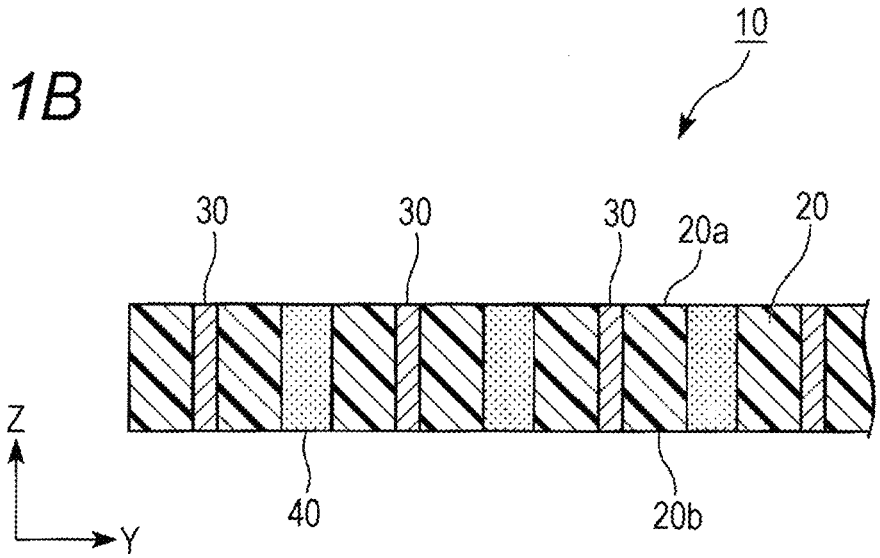

FIGS. 1A and 1B illustrate schematic configurations of an electric connector according to the present embodiment, where FIG. 1A is a plan view, and FIG. 1B is a sectional view along line A-A in (a).

As illustrated in FIGS. 1A and 1B, an electric connector 10 according to the present embodiment includes a resin layer 20, and a large number of metal wires 30 extending through the resin layer 20 in the thickness direction. The metal wires 30 each have a rectangular shape on one principal surface (top surface) 20*a* and the other principal surface (bottom surface) 20*b* of the resin layer 20. At least first sides of the rectangular shapes are arranged at equal intervals along an X direction. The short sides of the rectangular shapes of the metal wires 30 have a length of less than 5 μm.

In the present invention, each of the four interior angles of the "rectangular shape" does not need to be precisely 90 degrees, and the "rectangular shape" may be considered as a linear shape having some thickness. In such a case, the length of the long side of the rectangular shape corresponds to the length of the linear shape, and the length of the short side of the rectangular shape corresponds to the thickness of the linear shape.

The electric connector 10 is disposed between a connection terminal of a first device not illustrated, and a connection terminal of a second device not illustrated, and is designed to electrically connect these connection terminals. The one principal surface 20*a* of the electric connector 10 serves as a first connecting surface to one device, and the other principal surface 20*b* serves as a second connecting surface to the other device. In the electric connector 10, the metal wires 30 are members for electrically connecting the connection terminal of the first device and the connection terminal of the second device.

Examples of the devices include a semiconductor package, a circuit board, a silicon wafer, a passive component, a liquid crystal module, and a sensor.

The resin layer 20 is prepared by connecting (laminating) a series of a plurality of elastic bodies 21 having the same shape, in a first direction (the Y direction illustrated in FIG. 1A), with adhesion layers 40 interposed therebetween. The number of the elastic bodies 21 connected in a series, that is, the length of the resin layer 20 in the first direction (laminated direction) is not limited to any particular number, and may be adjusted as appropriate depending on the number of, the size (area) of, or the pitch of electrodes to be inspected. The length of the resin layer 20 may be 1 mm to 250 mm, for example. The length of the resin layer 20 in a second direction (the length in the X direction in FIG. 1A) is not limited to any particular length, and may be adjusted as appropriate depending on the number of, the size (area) of, or the pitch of the electrodes to be inspected, and may be 1 mm to 250 mm, for example. In the explanation herein, the X direction and the Y direction are perpendicular to each other.

It is not necessary for the elastic bodies 21 to be laminated with the adhesion layers 40 interposed therebetween, and it is also possible to manufacture an electric connector 10 without the adhesion layers 40, using the method for manufacturing an electric connector to be described later. The metal wires 30 are embedded in the elastic bodies 21.

The metal wires 30 are arranged at equal intervals along the center line of the long-side direction of the elastic bodies 21 (in the X direction in FIG. 1A).

The elastic bodies 21 are also connected in a series in such a manner that the metal wires 30 embedded in the elastic bodies 21 extend in parallel with one another in a view in the X direction, and positioned on top of one another in a view in the Y direction. As a modification, the metal wires 30 may be disposed offset with respect to one another (not on top of one another) in the view from the Y direction. The way in which the metal wires 30 are disposed on top of one another in the Y direction may be adjusted during manufacturing based on the arrangement of the connection terminals of the device to be connected.

The thickness of the resin layer 20 (the length in the Z direction illustrated in FIG. 1B), that is, the distance between the one principal surface 20*a* and the other principal surface 20*b* is, for example, equal to or more than 0.01 mm and equal to or less than 10 mm, and, from the viewpoint of reducing the thickness, it is preferable for the thickness to be equal to or more than 0.03 mm and equal to or less than 5 mm.

A length $L_1$ of the short side of the rectangular shape of the metal wire 30, on the one principal surface 20*a* and the other principal surface 20*b* of the resin layer 20, is preferably equal to or more than 0.01 μm and less than 5 μm, more preferably equal to or more than 0.05 μm and less than 4 μm, even more preferably equal to or more than 0.1 μm and less than 3 μm, and most preferably equal to or more than 0.3 μm and less than 2 μm.

When the length $L_1$ of the short side of the rectangular shape of the metal wire 30 is less than 5 μm, it is possible to reduce the chances of damaging the electrodes to be inspected, and to establish an electric connection to small-pitched electrodes. Furthermore, when the length $L_1$ of the short side is equal to or more than 0.01 μm, the durability of the electric connector can be improved, while suppressing damage of the metal wire 30.

A length $L_2$ of the long side of the rectangular shape of the metal wires 30 on the one principal surface 20*a* and the other principal surface 20*b* of the resin layer 20 is preferably equal to or more than 0.01 μm and less than 150 μm, more preferably equal to or more than 0.05 μm and less than 100 μm, and even more preferably equal to or more than 0.1 μm and less than 50 μm.

When the length $L_2$ of the long side of the rectangular shape of the metal wire 30 is equal to or less than 150 μm, an electrical connection with small-pitched electrodes can be established easily. When the length $L_2$ of the long side is equal to or more than 0.01 μm, the durability of the electric connector can be improved, while suppressing damage of the metal wire 30.

The ratio $L_1/L_2$ of the length $L_1$ of the short side of the rectangular shape with respect to the length $L_2$ of the long side of the metal wires 30 is, for example, preferably 0.001 to 0.7, more preferably 0.01 to 0.6, and even more preferably 0.02 to 0.5.

When $L_1/L_2$ is equal to or higher than the lower limit of the range mentioned above, durability of the metal wire 30 and the electric connector 10 is improved. When $L_1/L_2$ is equal to or lower than the upper limit of the range mentioned above, it is possible to connect the device stably with a small compressing force, and to prevent damage of the electrodes of the device to be connected.

It is preferable for the metal wires 30 to occupy an area equal to or less than 25% of the one principal surface 20*a* and the other principal surface 20*b* of the resin layer 20. Furthermore, the lower limit of the area occupied by the metal wires 30 in the one principal surface 20*a* and the other principal surface 20*b* of the resin layer 20 may be set to 0.06% or more, or 0.14% or more.

When the metal wires 30 occupy an area equal to or less than 25% of the one principal surface 20*a* and the other principal surface 20*b* of the resin layer 20, it is possible to reduce the chances of damaging the electrodes to be inspected.

On the one principal surface 20*a* and the other principal surface 20*b* of the resin layer 20, a pitch $P_1$ between the metal wires 30 in a short-side direction of the rectangular shape of the metal wires 30 is preferably equal to or less than 0.2 mm, more preferably equal to or less than 0.05 mm, and even more preferably equal to or less than 0.03 mm. Furthermore, the lower limit of the pitch $P_1$ between the metal wires 30 in the short-side direction of the rectangular shape of the metal wires 30 may be set to 0.001 mm or more.

When the pitch $P_1$ between the metal wires 30 in the short-side direction of the rectangular shape is equal to or less than 0.2 mm, an electrical connection with small-pitched electrodes can be established easily.

On the one principal surface 20*a* and the other principal surface 20*b* of the resin layer 20, a pitch $P_2$ between the metal wires 30 in a long-side direction of the rectangular shape of the metal wires 30 is preferably equal to or less than 0.2 mm, more preferably equal to or less than 0.05 mm, and even more preferably equal to or less than 0.03 mm. Furthermore, the lower limit of the pitch $P_2$ between the metal wires 30 in the long-side direction of the rectangular shape of the metal wire 30 may be set to 0.02 mm or more.

When the pitch $P_2$ between the metal wires 30 in the long-side direction of the rectangular shape is equal to or less than 0.2 mm, an electrical connection with small-pitched electrodes can be established easily.

The material of the elastic bodies 21 making up the resin layer 20 is not limited to any particular material, as long as the material has elastic and insulating properties, and examples thereof include silicone rubber, fluororubber, polybutadiene rubber, polyisoprene rubber, polyurethane rubber, chloroprene rubber, polyester rubber, styrene-butadiene copolymer rubber, and natural rubber. Among these alternatives, silicone rubber is preferable because silicone rubber is highly elastic and highly heat resistant.

Examples of the material of the metal wires 30 include gold, platinum, silver, copper, nickel, rhodium, palladium, black ruthenium, and alloys thereof. Gold, platinum, silver, and copper having a high standard electrode potential are more preferable, and gold and silver that are less hard are even more preferable. The metal wire 30 may also have a structure including layers of one or more of the same or a plurality of materials.

The adhesive used in the adhesion layer 40 is not limited to any particular adhesive, but it is possible to use an adhesive made of a material that is the same as that of the elastic bodies 21, or to use an adhesive made of a material that is different from that of the elastic bodies 21. Examples of the adhesive include silicone adhesive, modified silicone adhesive, natural latex rubber adhesive, urethane adhesive, polyvinyl chloride adhesive, chloroprene rubber adhesive, nitrile rubber adhesive, nitrocellulose adhesive, phenolic adhesive, polyimide adhesive, and polyvinyl alcohol adhesive. Among these adhesives, liquid silicone rubber, which can be easily applied as a thin film, is preferable. The liquid silicone rubber is in the liquid state when applied, but, as the liquid becomes cured, turned into less fluid or solid silicone rubber.

The electric connector 10 according to the present embodiment includes the resin layer 20, and a large number of the metal wires 30 extending through the resin layer 20 in the thickness direction. The metal wires 30 each have a rectangular shape on the surfaces to be connected to the connection terminal of the first device and the connection terminal of the second device. At least first sides of the rectangular shapes are arranged at equal intervals. The short sides of the rectangular shapes have a length of less than 5 μm. Therefore, when the connection terminals of the devices to be connected to the electric connector 10 are connected to the metal wires 30, no excessive force is applied from the metal wires 30 to the connection terminal of the device, and it is possible to prevent damage of the connection terminal.

Furthermore, by using the metal wires 30 having a rectangular connecting surface, a small-pitched, highly dense device can be connected. Furthermore, because the electric connector 10 according to the present embodiment is provided with the metal wires 30 the rectangular shape of which has a short-side length less than 5 μm, it is possible to ensure a large surficial area, and to achieve excellent high-frequency characteristics.

The metal wires 30 extending through the electric connector 10 may extend either perpendicularly to or diagonally to the one principal surface 20*a* and the other principal surface 20*b*, in the thickness direction (longitudinal direction).

When the metal wires 30 are oriented diagonally with respect to the thickness direction of the electric connector 10, it is preferable for the acute angle formed between the metal wire 30 and the normal line to the one principal surface 20*a* to be more than 0° and equal to or less than 60°, more preferably equal to or more than 1° and equal to or less than 45°, and even more preferably equal to or more than 10° and equal to or less than 30°. With such an angle range, a stable connection can be achieved easily with a low load, and it is possible to reduce the chances of damaging the terminal of the device to be connected. This angle is adjusted as appropriate, depending on the arrangement of the connection terminals on the two devices that are to be connected thereto. This angle is found by observing five or more metal wires 30 on a cross section in the thickness direction of the electric connector 10, by capturing an image of the metal wires 30, using means enabling observations in an enlarged size, such as a digital microscope, by making measurements based on the captured image, and by taking an average of the measurements.

The ends of the metal wires 30 included in the electric connector 10 may project from at least one of the one principal surface 20*a* and the other principal surface 20*b*. An "end of a metal wire" corresponds to a range equivalent to ¼ of the entire length of the metal wire, measured from the tip of the metal wire. When the ends of the metal wires 30 project from the principal surface, the amount of projection is not limited to any particular amount, and is adjusted as an appropriate, based on the shape, arrangement, and the like of the connection terminals of the two devices that are electrically connected to each other via the electric connector 10.

When the ends of the metal wires 30 of the electric connector 10 project from the one principal surface 20*a* or the other principal surface 20*b*, it is possible for these projecting ends to have a plating layer, by being applied with plating. The material of the plating layer is not limited to any particular material, and is selected as appropriate depending on the material of the metal wires 30. With the plating layer, the surficial area (cross-sectional area) of the end of the metal wire 30 increases, and thus the area by which the end of the metal wire 30 is brought into contact with the connection terminal of the connected device increases. It is therefore possible to keep stable electric connection between them.

[Electric Connector Manufacturing Method]

A method for manufacturing the electric connector according to the present embodiment includes a step of providing a plating layer on one surface of a base material (hereinafter, referred to as "Step A1"); a step of providing a large number of (that is, a plurality of) metal wires that are arranged at equal intervals along the same direction, by laser-machining the plating layer (hereinafter, referred to as "Step B1"); a step of providing a first rubber sheet by bonding one surface of a first clay-like rubber sheet onto the metal wires provided on the one surface of the base material, and then vulcanizing the first clay-like rubber sheet (hereinafter, referred to as "Step C1"); a step of removing the base material by wet-etching so that the metal wires are left on the one surface of the first rubber sheet (hereinafter, referred to as "Step D1"); a step of forming an elastic body including the first rubber sheet, the metal wires, and a second rubber sheet, with the second rubber sheet formed by bonding a second clay-like rubber sheet onto the one surface of the first rubber sheet in a manner covering the metal wires, and then vulcanizing the second clay-like rubber sheet (hereinafter, referred to as "Step E1"); a step of forming a laminate by laminating a plurality of the elastic bodies in such a manner that the metal wires included in a first elastic body and those included in a second elastic body are positioned in parallel with one another, when these elastic bodies are laminated (hereinafter, referred to as "Step F1"); and a step of cutting the laminate perpendicularly or diagonally to an extending direction of the metal wires (hereinafter, referred to as "Step G1").

The method for manufacturing an electric connector according to the present embodiment will now be explained with reference to FIGS. 2A to 2D and FIGS. 3A to 3C. In FIGS. 2A to 2D and 3A to 3C, the elements that are the same as those illustrated in FIGS. 1A and 1B will be given the same reference signs, and redundant explanations thereof will be omitted.

Figure 2A:
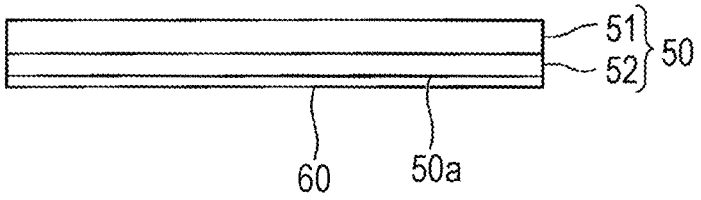
FIGS. 2A to 2D are sectional views schematically illustrating a method for manufacturing an electric connector according to the first embodiment.

As illustrated in FIG. 2A, a plating layer 60 is provided on one surface 50*a* of a base material 50 (Step A1).

In Step A1, the plating layer 60 is formed on the one surface 50*a* of the base material 50 by electroplating or electroless plating.

The base material 50 is not limited to any particular material, as long as the plating layer 60 can be formed thereon by electroplating or electroless plating. As the base material 50, for example, a laminate of a first layer 51 made of copper, brass, or a copper alloy such as phosphor bronze and nickel silver, and a second layer 52 made of nickel or zinc, as illustrated in FIG. 2A may be used. It is also possible to use one of these metal alloys or a water-soluble film having a layer of gold plating, platinum plating, silver plating, copper plating, nickel plating, rhodium plating, palladium plating, or black ruthenium plating provided on one surface. One example of the water-soluble film is polyvinyl alcohol.

As the material of the plating layer 60, for example, a metal such as gold, platinum, silver, copper, nickel, or an alloy thereof may be used.

Figure 2B:
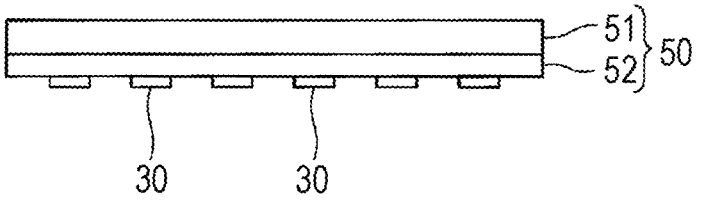

As illustrated in FIG. 2B, a large number of metal wires 30 arranged at equal intervals along the same direction are formed on the one surface 50*a* of the base material 50 by laser-machining the plating layer 60 (Step B1).

The wavelength of the laser used in the laser machining is not limited to any particular wavelength, as long as the plating layer 60 can be machined. In Step B1, forming the metal wires 30 by machining the plating layer 60 uses laser at a wavelength of 532 nm or 355 nm, which can easily machine a highly reflective material such as gold or copper, which is less likely to heat the surface being machined, and which allows finer micromachining than that achieved with the fundamental wave at a wavelength of 1064 nm.

Figure 2C:
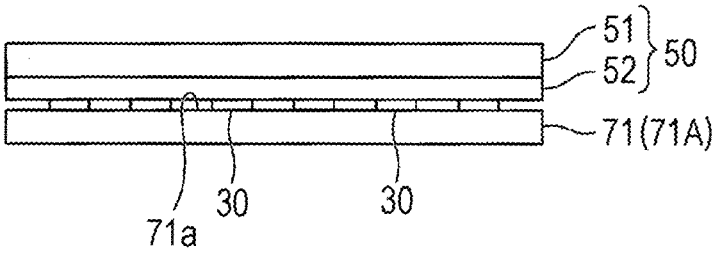

As illustrated in FIG. 2C, a first rubber sheet 71A is then formed by bonding one surface 71*a* of the first clay-like rubber sheet 71 onto the metal wires 30 formed on the one surface 50*a* of the base material 50, and then vulcanizing the first clay-like rubber sheet 71 (Step C1).

The first clay-like rubber sheet 71 is not limited to that of any particular type, and examples thereof include clay-like silicone rubber, clay-like fluororubber, clay-like polybutadiene rubber, clay-like polyisoprene rubber, clay-like polyurethane rubber, clay-like chloroprene rubber, clay-like polyester rubber, clay-like styrene-butadiene copolymer rubber, and clay-like natural rubber that are vulcanized and become cured by heat, light, or irradiation with electromagnetic waves.

The clay-like rubber sheet is obtained by adding a vulcanizing agent and necessary additives to a millable compound, and kneading the compound.

A specific example of the clay-like silicone rubber includes what is called a rubber compound such as KE-174-U available from Shin-Etsu Chemical Co., Ltd.

The hardness of the cured clay-like silicone rubber (Durometer A) is preferably equal to or higher than 20, and more preferably equal to or higher than 30. The upper limit of this hardness is preferably set to equal to or lower than 90. If the hardness is within the range, it is possible to give the electric connector an appropriate rigidity.

The hardness is measured in accordance with the method specified in JIS K 6249:2003.

The thickness of the first clay-like rubber sheet 71 is not limited to any particular thickness, and is adjusted as appropriate, depending on the required thickness of the resin layer 20 formed by connecting the elastic bodies 21 made from the first clay-like rubber sheets 71. For example, the thickness may be 0.0005 mm to 0.5 mm. The sheet may also be referred to as a film.

In Step C1, the first rubber sheet 71A is formed by heating and vulcanizing the first clay-like rubber sheet 71.

Figure 2D:
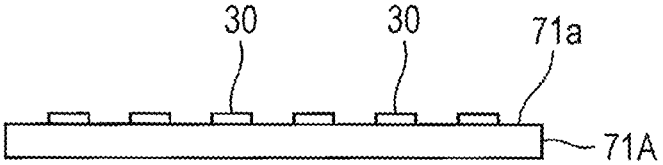

As illustrated in FIG. 2D, the base material 50 is then removed by wet-etching so that the metal wires 30 are left on the one surface 71*a* of the first rubber sheet 71A (Step D1).

When copper is used as the base material 50, the base material 50 on which the metal wires 30 are formed, and that has the first rubber sheet 71 bonded thereon is immersed in ferric chloride solution. When a water-soluble film is used as the base material 50, the base material 50 on which the metal wires 30 are formed, and that has the first rubber sheet 71 bonded thereon is immersed in water. In this manner, the base material 50 is removed.

In Step D1, the base material 50 is removed by wet-etching so that the metal wires 30 are left on the one surface 71*a* of the first rubber sheet 71A. In other words, the metal wires 30 are transferred onto the one surface 71*a* of the first rubber sheet 71A.

Figure 3A:
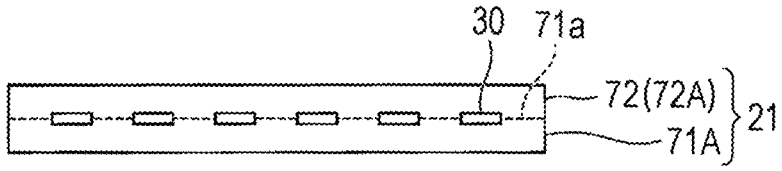
FIGS. 3A to 3C are sectional views schematically illustrating the method for manufacturing an electric connector according to the first embodiment.

As illustrated in FIG. 3A, a second rubber sheet 72A is then formed, by bonding the second clay-like rubber sheet 72 onto the one surface 71*a* of the first rubber sheet 71A in a manner covering the metal wires 30, and then vulcanizing the second clay-like rubber sheet 72. In this manner, the elastic body 21 including the first rubber sheet 71A, the metal wires 30, and the second rubber sheet 72A is formed (Step E1).

As the second clay-like rubber sheet 72, it is preferable to use the same type of sheet as the first clay-like rubber sheet 71.

It is also preferable to set the thickness of the second clay-like rubber sheet 72 to the thickness that is the same as that of the first clay-like rubber sheet 71.

In Step E1, the second rubber sheet 72A is formed by heating and vulcanizing the second clay-like rubber sheet 72.

Figure 3B:
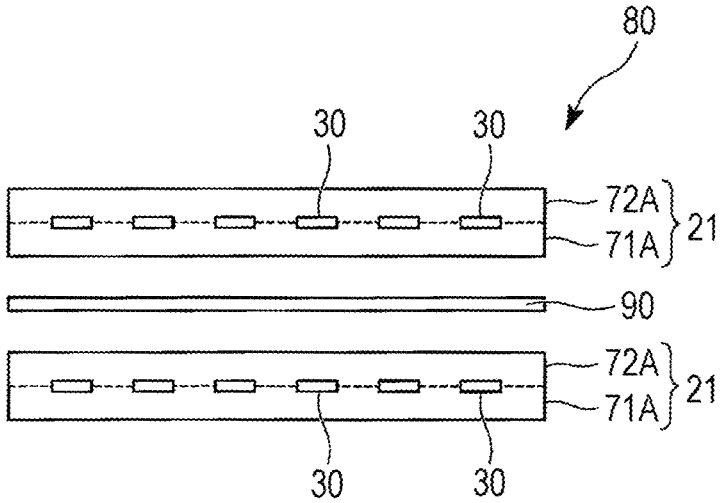

As illustrated in FIG. 3B, a laminate 80 is then formed by laminating a plurality of the elastic bodies 21 achieved as a result of Steps A1 to E1 in such a manner that the metal wires 30 extend in parallel in a view from a direction perpendicularly intersecting with a laminated direction of the elastic bodies 21, and that the metal wires 30 come to position on top of one another in a view in the laminated direction of the elastic bodies 21 (Step F1).

Examples of the method for laminating the elastic bodies 21 include a method using an adhesive 90, and a method of chemically binding the elastic bodies 21 by activating the surfaces of the elastic bodies 21 by applying surface treatment such as corona discharge, vacuum ultraviolet radiation to the surfaces.

As the adhesive 90, the same or a similar adhesive as the one in the adhesion layer 40 is used.

Specific examples of the liquid silicone rubber, which is one example of the adhesive, include those that become thermally cured as a result of an addition reaction, e.g., KE-1935-A and KE-1935-B available from Shin-Etsu Chemical Co., Ltd.

The viscosity of the uncured liquid silicone rubber is markedly lower than that of the clay-like silicone compound, and is preferably equal to or lower than 500 Pa·s, more preferably equal to and lower than 200 Pa·s, and even more preferably equal to and lower than 100 Pa·s, for example. As the lower limit of the viscosity, 10 Pa·s or higher is preferable.

The concentration ([g/cm$^3$] at 23° C.) of the uncured liquid silicone rubber is preferably lower than that of the clay-like silicone rubber, and, for example, preferably less than 1.10, preferably equal to or lower than 1.06, and even more preferably equal to or lower than 1.03. The lower limit of this concentration is usually equal to or higher than 1.00. If the concentration is within the range mentioned above, the liquid silicone rubber can be applied smoothly.

The hardness of the cured liquid silicone rubber (Durometer A) is preferably equal to or higher than 20, and is more preferably equal to or higher than 30. The upper limit of this hardness is preferably 90 or lower. When the hardness is within the range mentioned above, it is possible to give the electric connector an appropriate rigidity.

The viscosity, the concentration, and the hardness are measured in accordance with the method specified in JIS K 6249:2003.

Figure 3C:
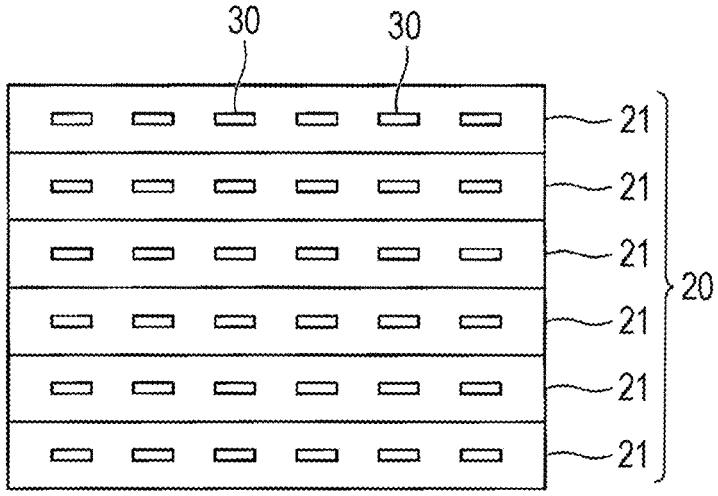

The laminate 80 resultant of Step F1 is then cut perpendicularly or diagonally to the extending direction of the metal wires 30 (that is, in the depth direction with respect to the paper surface in FIG. 3C) (Step G1). When the laminate 80 is cut perpendicularly, the extending direction of the metal wires 30 in the electric connector 10 becomes perpendicular to the one principal surface 20*a* and the other principal surface 20*b*. When the laminate 80 is cut diagonally, the extending direction of the metal wires 30 in the electric connector 10 becomes diagonal to the one principal surface 20*a* and the other principal surface 20*b*, and also becomes diagonal to the thickness direction of the electric connector 10.

In this manner, the electric connector 10 is obtained, as illustrated in FIG. 3C.

In the manufacturing method according to the first embodiment explained above, it is also possible to use rubber sheets made of liquid silicone, instead of the first and the second clay-like rubber sheets. When rubber sheets made of liquid silicone are to be used, it is preferable to use sheets of semi-cured liquid silicone, or sheets resultant of forming less fluid liquid silicone.

Second Embodiment

[Electric Connector Manufacturing Method]

A method for manufacturing an electric connector according to the present embodiment includes a step of providing a plating layer on one surface of a base material (hereinafter, referred to as "Step A2"); a step of providing a first rubber sheet by bonding one surface of a first clay-like rubber sheet onto the plating layer provided on the one surface of the base material, and then vulcanizing the first clay-like rubber sheet (hereinafter, referred to as "Step B2"); a step of removing the base material by wet-etching so that the plating layer is left on the one surface of the first rubber sheet (hereinafter, referred to as "Step C2"); a step of providing a large number of (that is, a plurality of) metal wires that are arranged at equal intervals along the same direction, by laser-machining the plating layer (hereinafter, referred to as "Step D2"); a step of forming an elastic body including the first rubber sheet, the metal wires, and a second rubber sheet, with the second rubber sheet being formed by bonding one surface of a second clay-like rubber sheet onto one surface of the first rubber sheet in a manner covering the metal wires, and then vulcanizing the second clay-like rubber sheet (hereinafter, referred to as "Step E2"); a step of forming a laminate by laminating a plurality of elastic bodies in such a manner that the metal wires included in a first elastic body and those included in a second elastic body are positioned in parallel with one another, when these elastic bodies are laminated (hereinafter, referred to as "Step F2"); and a step of cutting the laminate perpendicularly or diagonally to the extending direction of the metal wires (hereinafter, referred to as "Step G2").

Instead of the first and the second clay-like rubber sheets, it is also possible to use rubber sheets made of liquid silicone. When rubber sheets made of liquid silicone are used, it is preferable to use sheets of semi-cured liquid silicone, or sheets resultant of forming less fluid liquid silicone.

The method for manufacturing an electric connector according to the present embodiment will now be explained with reference to FIGS. 4A to 4D and FIGS. 5A to 5C. In FIGS. 4A to 4D and 5A to 5C, the elements that are the same as those illustrated in FIGS. 1A to 3C will be given the same reference signs, and redundant explanations thereof will be omitted.

Figure 4A:
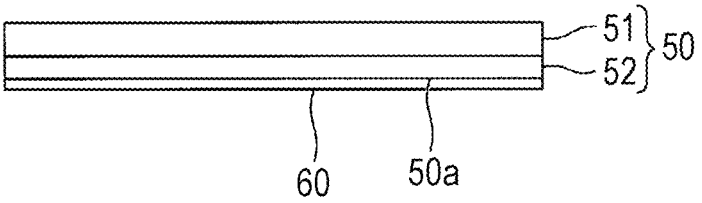
FIGS. 4A to 4D are sectional views schematically illustrating a method for manufacturing an electric connector according to a second embodiment.

As illustrated in FIG. 4A, a plating layer 60 is provided on one surface 50*a* of the base material 50 (Step A2).

In Step A2, the plating layer 60 is formed on the one surface 50*a* of the base material 50 by electroplating or electroless plating, in the same manner as in Step A1 described above.

Figure 4B:
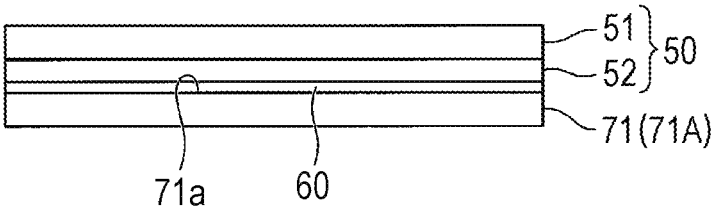

As illustrated in FIG. 4B, the first rubber sheet 71A is then formed, by bonding one surface 71*a* of the first clay-like rubber sheet 71 onto the plating layer 60 formed on the one surface 50*a* of the base material 50, and then vulcanizing the first clay-like rubber sheet 71 (Step B2).

In Step B2, the first clay-like rubber sheet 71 is vulcanized in the same manner as in Step C1 described above.

Figure 4C:
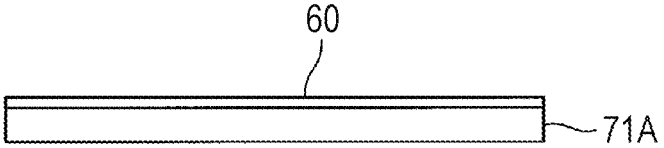

As illustrated in FIG. 4C, the base material 50 is then removed by wet-etching so that the plating layer 60 is left on the one surface 71*a* of the first rubber sheet 71A (Step C2).

In Step C2, the base material 50 is removed by wet-etching, in the same manner as in Step D1 described above.

Figure 4D:
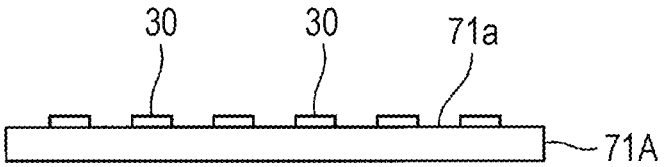

As illustrated in FIG. 4D, a large number of the metal wires 30 arranged at equal intervals along the same direction are then formed on the one surface 71*a* of the first rubber sheet 71A, by laser-machining the plating layer 60 (Step D2).

In Step D2, the plating layer 60 is laser-machined in the same manner as in Step B1 described above.

Figure 5A:
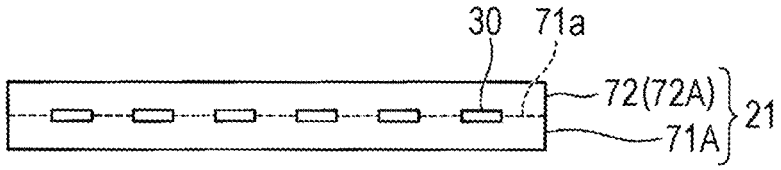
FIGS. 5A to 5C are sectional views schematically illustrating the method for manufacturing an electric connector according to the second embodiment.

As illustrated in FIG. 5A, the second rubber sheet 72A is then formed, by bonding the second clay-like rubber sheet 72 onto the one surface 71*a* of the first rubber sheet 71A in a manner covering the metal wires 30, and then vulcanizing the second clay-like rubber sheet 72. In this manner, the elastic body 21 including the first rubber sheet 71A, the metal wires 30, and the second rubber sheet 72A is formed (Step E2).

In Step E2, the elastic body 21 is formed in the same manner as in Step E1 described above.

Figure 5B:
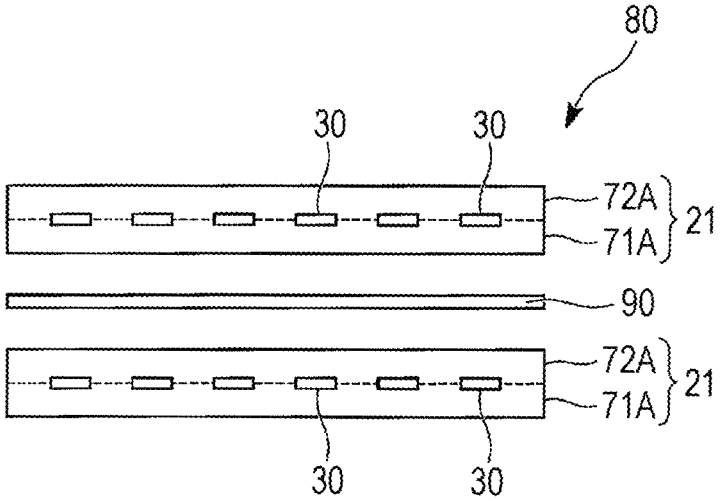

As illustrated in FIG. 5B, a laminate 80 is then formed by laminating a plurality of the elastic bodies 21 achieved as a result of Steps A2 to E2 in such a manner that the metal wires 30 are in parallel with one another in a view in a direction perpendicularly intersecting with the laminated direction of the elastic bodies 21, and that the metal wires 30 come to position on top of one another in the view along the laminated direction of the elastic bodies 21 (Step F2).

In Step F2, the laminate 80 is formed in the same manner as in Step F1 described above.

Figure 5C:
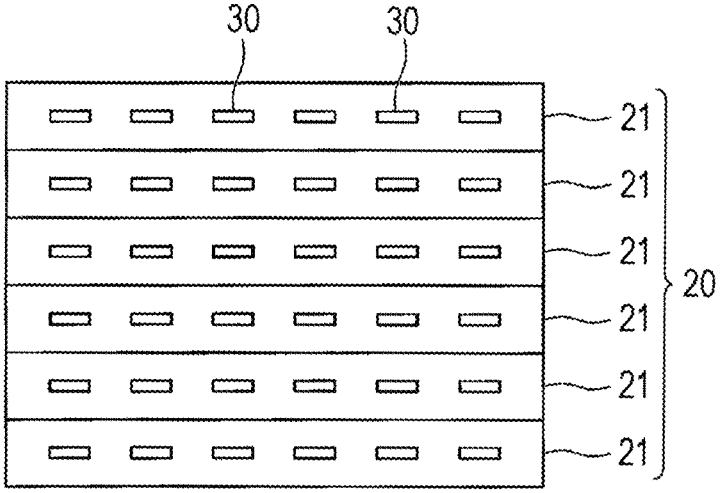

The laminate 80 resultant of Step F2 is cut perpendicularly to the extending direction of the metal wires 30 (that is, the depth direction with respect to the paper surface in FIG. 5C) (Step G2).

In this manner, as illustrated in FIG. 5C, the electric connector 10 is achieved.

Third Embodiment

[Electric Connector Manufacturing Method]

A method for manufacturing an electric connector according to the present embodiment includes a step of providing a large number of (that is, a plurality of) metal wires that are arranged at equal intervals along the same direction, by applying metal nano-paste onto one surface of a base material (hereinafter, referred to as "Step A3"); a step of providing a first rubber sheet by bonding one surface of a first clay-like rubber sheet onto the metal wires provided on the one surface of the base material, and then vulcanizing the first clay-like rubber sheet (hereinafter, referred to as "Step B3"); a step of removing the base material by wet-etching so that the metal wires are left on the one surface of the first rubber sheet (hereinafter, referred to as "Step C3"); a step of forming an elastic body including the first rubber sheet, the metal wires, and a second rubber sheet, with the second rubber sheet being formed by bonding one surface of a second clay-like rubber sheet onto the one surface of the first rubber sheet in a manner covering the metal wires, and then vulcanizing the second clay-like rubber sheet (hereinafter, referred to as "Step D3"); a step of forming a laminate by laminating a plurality of elastic bodies in such a manner that the metal wires included in a first elastic body and those included in a second elastic body are positioned in parallel with one another, when these elastic bodies are laminated (hereinafter, referred to as "Step E3"); and a step of cutting the laminate perpendicularly or diagonally to the extending direction of the metal wires (hereinafter, referred to as "Step F3").

Instead of the first and the second clay-like rubber sheets, it is also possible to use rubber sheets made of liquid silicone. When rubber sheets made of liquid silicone are used, it is preferable to use sheets of semi-cured liquid silicone, or sheets resultant of forming less fluid liquid silicone.

The method for manufacturing an electric connector according to the present embodiment will now be explained with reference to FIGS. 6A to 6C and FIGS. 7A to 7C. In FIGS. 6A to 6C and 7A to 7C, the elements that are the same as those illustrated in FIGS. 1A to 3C will be given the same reference signs, and redundant explanations thereof will be omitted.

Figure 6A:
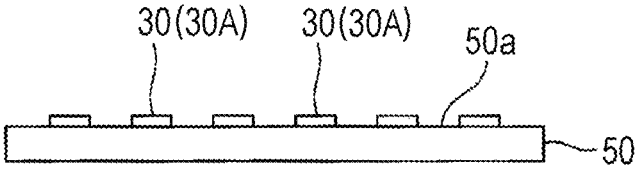
FIGS. 6A to 6C are sectional views schematically illustrating a method for manufacturing an electric connector according to a third embodiment.

As illustrated in FIG. 6A, a large number of the metal wires 30 arranged at equal intervals along the same direction are formed, by applying metal nano-paste to the one surface 50*a* of the base material 50 (Step A3).

In Step A3, as a method for forming the metal wires 30 on the one surface 50*a* of the base material 50, thin lines 30A are drawn with the metal nano-paste, on the one surface 50*a* of the base material 50, via electrostatic discharge, for example. At this time, a large number of thin lines 30A are formed in a manner arranged at equal intervals along the same direction, on the one surface 50*a* of the base material 50.

An example of the metal nano-paste is nanosized metal particles of metal such as gold, platinum, silver, copper, nickel, or an alloy thereof (having an average particle diameter less than 1 nm to 1 μm) distributed in binder resin. As the metal nano-paste, a commercially available product may be used.

These thin lines 30A, as well as the base material 50, are then fired, and turned into the metal wires 30. As the firing temperature, it is preferable to use a temperature at which the base material 50 is not damaged by burning, and is 150 to 400° C. or so, for example. The base material 50 is preferably made of a material that does not become damaged at the time of firing.

Figure 6B:
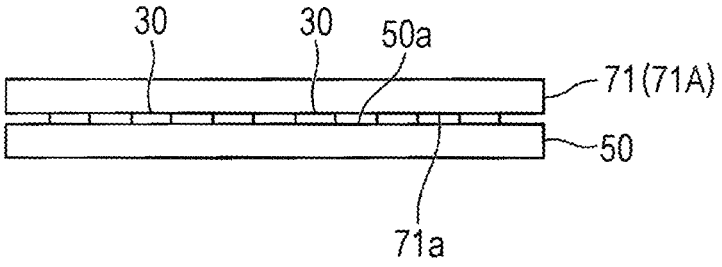

As illustrated in FIG. 6B, the first rubber sheet 71A is then formed by bonding the one surface 71*a* of the first clay-like rubber sheet 71 onto the metal wires 30 formed on the one surface 50*a* of the base material 50, and then vulcanizing the first clay-like rubber sheet 71 (Step B3).

In Step B3, the first clay-like rubber sheet 71 is vulcanized, in the same manner as in Step C1 described above.

Figure 6C:
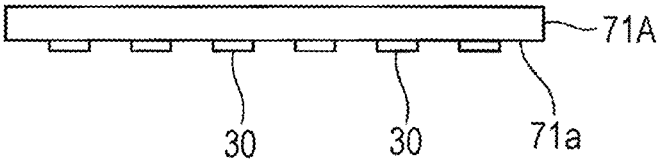

As illustrated in FIG. 6C, the base material 50 is removed by wet-etching so that the metal wires 30 are left on the one surface 71*a* of the first rubber sheet 71A (Step C3).

In Step C3, the base material 50 is removed by wet-etching, in the same manner as in Step D1 described above.

Figure 7A:
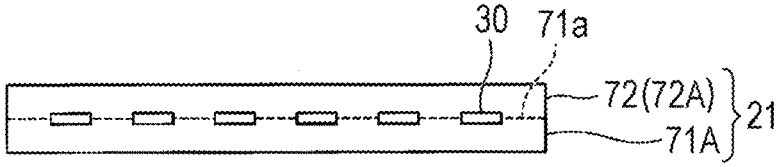
FIGS. 7A to 7C are sectional views schematically illustrating the method for manufacturing an electric connector according to the third embodiment.

As illustrated in FIG. 7A, the second rubber sheet 72A is then obtained by bonding the second clay-like rubber sheet 72 onto the one surface 71*a* of the first rubber sheet 71A in a manner covering the metal wires 30, and then vulcanizing the second clay-like rubber sheet 72. In this manner, the elastic body 21 including the first rubber sheet 71A, the metal wires 30, and the second rubber sheet 72A is formed (Step D3).

In Step D3, the elastic body 21 is formed in the same manner as in Step E1 described above.

Figure 7B:
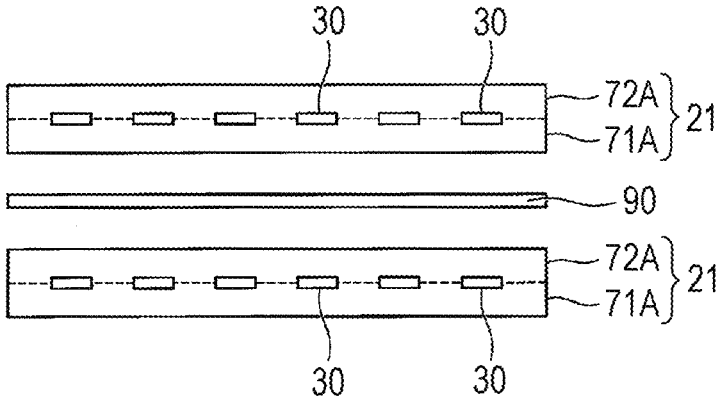

As illustrated in FIG. 7B, a laminate 80 is then formed by laminating a plurality of the elastic bodies 21 achieved as a result of Steps A3 to D3, in such a manner that the metal wires 30 extend in parallel in a view in a direction perpendicularly intersecting with the laminated direction of the elastic bodies 21, and that the metal wires 30 come to position on top of one another in the view along the laminated direction of the elastic bodies 21 (Step E3).

In Step E3, the laminate 80 is formed in the same manner as in Step F1 described above.

Figure 7C:
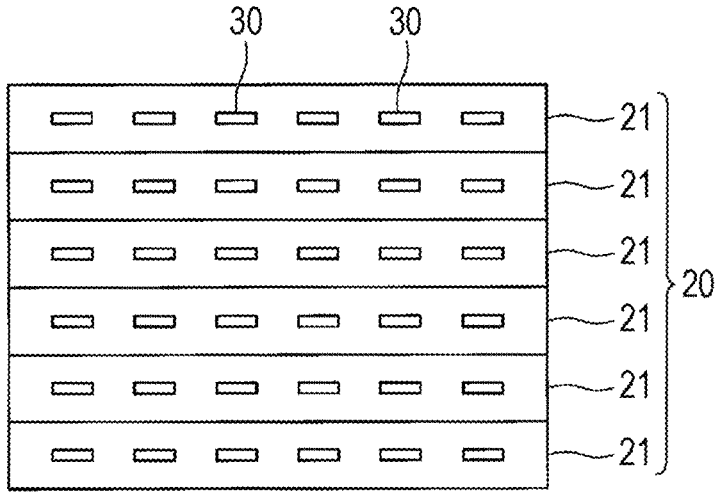

The laminate 80 resultant of Step E3 is cut perpendicularly to the extending direction of the metal wires 30 (that is, in the depth direction with respect to the paper surface in FIG. 7C) (Step F3).

In this manner, as illustrated in FIG. 7C, the electric connector 10 is achieved.

Fourth Embodiment

[Electric Connector Manufacturing Method]

A method for manufacturing an electric connector according to the present embodiment includes a step of applying liquid silicone rubber onto one surface of a silicon wafer mold that is a silicon wafer, the one surface being provided with a large number of (that is, a plurality of) band-like grooves arranged at equal intervals along the same direction, and the liquid silicone rubber being applied in such a manner that the liquid silicone rubber gets inside of the grooves on the silicon wafer mold, and then vulcanizing the liquid silicone rubber, to obtain a silicone rubber mold having protrusions and recesses corresponding to the grooves of the silicon wafer mold (hereinafter, referred to as "Step A4"); a step of providing a precursors of a plurality of metal wires by applying metal nano-paste onto the protrusions of the silicone rubber mold (hereinafter, referred to as "Step B4"); a step of bonding one surface of a first clay-like rubber sheet onto the precursors of the metal wires formed on the protrusions of the silicone rubber mold, and transferring the precursors of the metal wires onto one surface of the first clay-like rubber sheet (hereinafter, referred to as "Step C4"); a step of providing a first rubber sheet by vulcanizing the first clay-like rubber sheet, and forming a large number of (that is, a plurality of) metal wires that are arranged at equal intervals along the same direction, on one surface of the first rubber sheet, by firing the precursors of the metal wires (hereinafter, referred to as "Step D4"); a step of forming an elastic body including the first rubber sheet, the metal wires, and a second rubber sheet, with the second rubber sheet being formed by bonding one surface of a second clay-like rubber sheet onto one surface of the first rubber sheet in a manner covering the metal wires, and then vulcanizing the second clay-like rubber sheet (hereinafter, referred to as "Step E4"); a step of forming a laminate by laminating a plurality of the elastic bodies in such a manner that the metal wires included in a first elastic body and those included in a second elastic body are positioned in parallel with one another, when these elastic bodies are laminated (hereinafter, referred to as "Step F4"); and a step of cutting the laminate perpendicularly or diagonally to the direction in the extending direction of the metal wires (hereinafter, referred to as "Step G4").

Instead of the first and the second clay-like rubber sheets, it is also possible to use rubber sheets made of liquid silicone. When rubber sheets made of liquid silicone are used, it is preferable to use sheets of semi-cured liquid silicone, or sheets resultant of forming less fluid liquid silicone.

The method for manufacturing an electric connector according to the present embodiment will now be explained with reference to FIGS. 8A to 8D and FIGS. 9A to 9E. In FIGS. 8A to 8D and 9A to 9E, the elements that are the same as those illustrated in FIGS. 1A to 3C will be given the same reference signs, and redundant explanations thereof will be omitted.

Figure 8A:
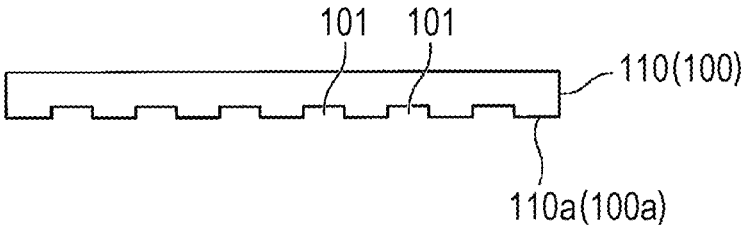
FIGS. 8A to 8D are sectional views schematically illustrating a method for manufacturing an electric connector according to a fourth embodiment.

As illustrated in FIG. 8A, a silicon wafer mold 110 is formed on one surface 100*a* of a silicon wafer 100, by forming a large number of band-like grooves 101 arranged at equal intervals along the same direction.

Examples of the method for forming the grooves 101 on the silicon wafer 100 include etching using acidic etchant, which is a dilution of hydrofluoric acid and nitric acid with pure water or acetic acid, or alkaline etchant, which is a dilution of potassium hydroxide and sodium hydroxide with pure water, and dry etching using plasma.

Figure 8B:
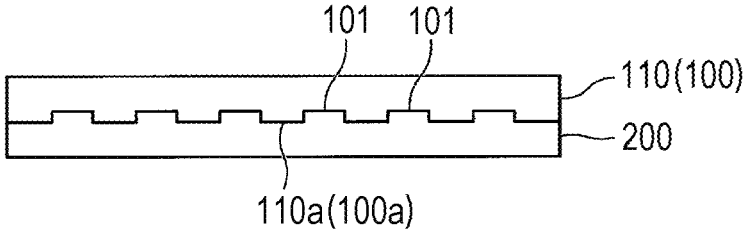
Figure 8C:
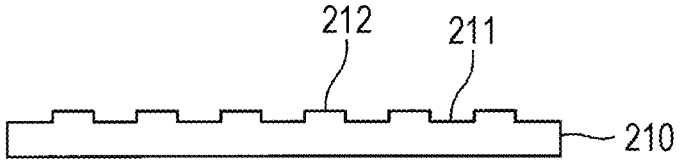

As illustrated in FIG. 8B, liquid silicone rubber 200 is applied onto the one surface 110*a* of the silicon wafer mold 110 in such a manner that the liquid silicone rubber 200 gets inside of the grooves 101 on the silicon wafer mold 110, and the liquid silicone rubber 200 is then vulcanized, as illustrated in FIG. 8C, to obtain a silicone rubber mold 210 having protrusions 212 and recesses 211 corresponding to the grooves 101 of the silicon wafer mold 110 (Step A4).

In Step A4, the liquid silicone rubber 200 is heated and vulcanized.

Figure 8D:
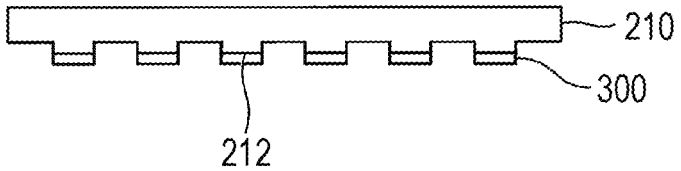

As illustrated in FIG. 8D, precursors 300 of the metal wires are then formed with metal nano-paste, on the protrusions 212 on the silicone rubber mold 210 (Step B4).

In Step B4, as a method for forming the precursors 300 of the metal wires on the protrusions 212 on the silicone rubber mold 210, it is possible to use a method of drawing, by transferring, the precursors 300 of the metal wires on the protrusions 212 of the silicone rubber mold 210.

Figure 9A:
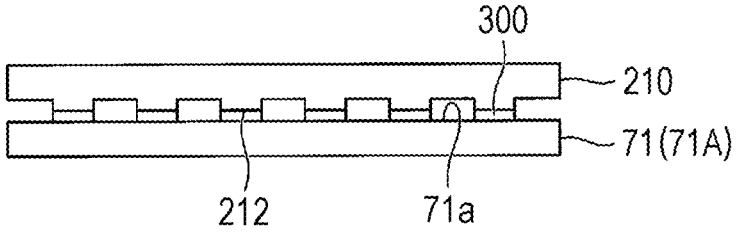
FIGS. 9A to 9E are sectional views schematically illustrating the method for manufacturing an electric connector according to the fourth embodiment.

As illustrated in FIG. 9A, one surface 71*a* of the first clay-like rubber sheet 71 is then bonded onto the precursors 300 of the metal wires formed on the protrusions 212 on the silicone rubber mold 210, and the precursors 300 of the metal wires are transferred onto the one surface 71*a* of the first clay-like rubber sheet 71 (Step C4).

Figure 9B:
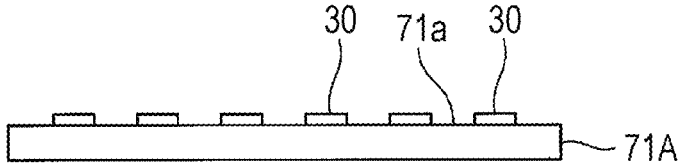

The first rubber sheet 71A is then formed by vulcanizing the first clay-like rubber sheet 71. In addition, by firing the precursors 300 of the metal wires, a large number of the metal wires 30 arranged at equal intervals along the same direction are provided on one surface 71*a* of the first rubber sheet 71A, as illustrated in FIG. 9B (Step D4).

In Step D4, when the precursors are fired, the first clay-like rubber sheet 71 may be heated and vulcanized at the same time. A preferred temperature for firing the precursors is, for example, 150 to 250° C. or so.

Figure 9C:
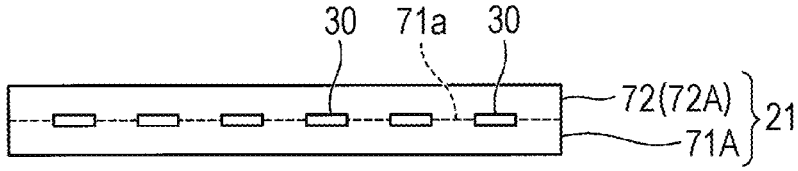

As illustrated in FIG. 9C, the second rubber sheet 72A is then formed by bonding the second clay-like rubber sheet 72 onto the one surface 71*a* of the first rubber sheet 71A in a manner covering the metal wires 30, and then vulcanizing the second clay-like rubber sheet 72. In this manner, the elastic body 21 including the first rubber sheet 71A, the metal wires 30, and the second rubber sheet 72A is formed (Step E4).

In Step E4, the elastic body 21 is formed in the same manner as in Step E1 described above.

Figure 9D:
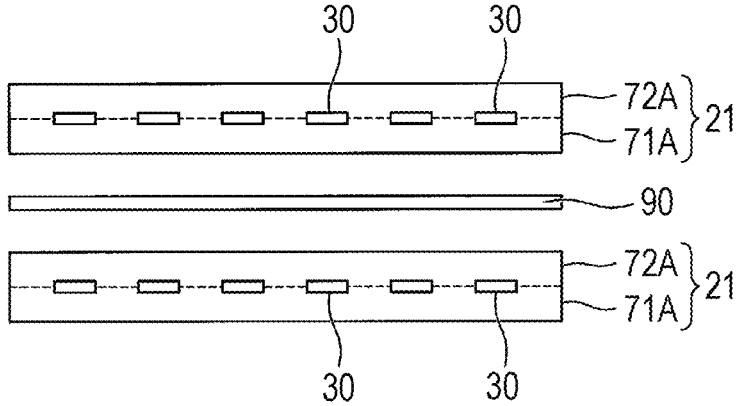

As illustrated in FIG. 9D, a laminate 80 is then formed by laminating a plurality of the elastic bodies 21 achieved as a result of Steps A4 to E4 in such a manner that the metal wires 30 come to position on top of one another (Step F4).

In Step F4, a laminate 80 is formed in the same manner as in Step F1 described above.

The laminate 80 resultant of Step F4 is then cut perpendicularly to the extending direction of the metal wires 30 (Step G4).

Figure 9E:
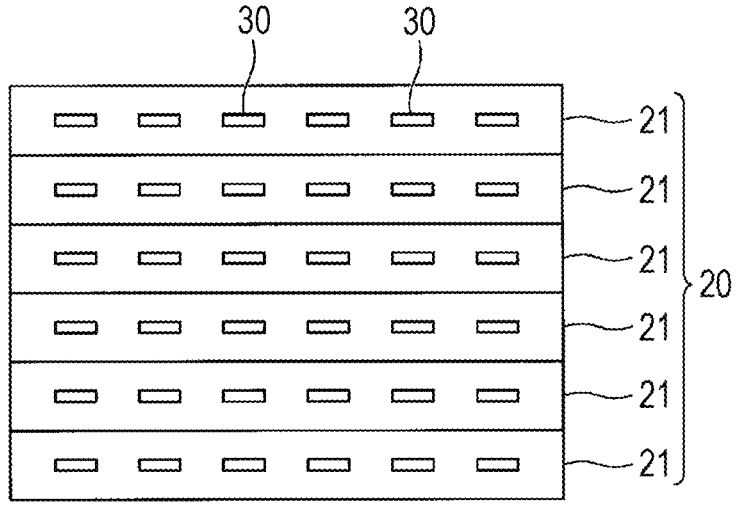

In this manner, the electric connector 10 is achieved, as illustrated in FIG. 9E.

Fifth Embodiment

[Electric Connector Manufacturing Method]

A method for manufacturing an electric connector according to the present embodiment includes a step of forming a plurality of metal wires that are arranged at equal intervals along the same direction on one surface of a base material that is provided with a line-and-space (L/S) resist pattern in which band-like grooves are arranged at equal intervals along the same direction, by forming a plating layer in the grooves where the one surface of the base material is exposed (hereinafter, referred to as "Step A5"); a step of removing the resist pattern from the one surface of the base material (hereinafter, referred to as "Step B5"); a step of providing a first rubber sheet by bonding one surface of a first unvulcanized rubber sheet onto the metal wires provided on the one surface of the base material, and then vulcanizing the first unvulcanized rubber sheet (hereinafter, referred to as "Step C5"); and a step of removing the base material by wet-etching so that the metal wires are left on the one surface of the first rubber sheet (hereinafter, referred to as "Step D5").

The unvulcanized rubber sheet may be made of clay-like silicone or liquid silicone. When liquid silicone is to be used, it is preferable to use semi-cured liquid silicone, or less fluid liquid silicone.

The base material used in Step A5 may be any base material having a conductivity allowing a plating layer to be provided on one surface thereof, and capable of being removed by wet-etching performed at subsequent Step D5. An example of the base material includes the base material explained for Step A1. A base material with the L/S resist pattern formed in advance on one surface thereof is used. The one surface of the base material is exposed, to the bottom surface of the grooves defined by the spaces in the L/S pattern. By forming a plating layer on the exposed one surface by an ordinary electroplating or electroless plating method, it is possible to obtain the metal wires extending along the longitudinal direction of the grooves, inside the grooves. By adjusting the pitch of the spaces in the L/S pattern, it is possible to adjust the pitch between the metal wires to be formed. Furthermore, by adjusting the thickness of the plating layer, it is possible to adjust the thickness of the metal wires. From the viewpoint of preventing short circuit between the formed metal wires, it is preferable for the resist pattern to have a thickness greater than the thickness of the plating layer.

The resist pattern provided on the base material used in Step A5 may be formed at this step, using an ordinary method, or it is also possible to purchase a base material with a desirable resist pattern formed in advance.

With Step A5 described above, it is possible to form a plurality of metal wires that are arranged at equal intervals along the same direction, on one surface of the base material.

In Step B5, the resist pattern is removed from the one surface of the base material, where the metal wires and the resist pattern are disposed. As a method for removing, wet-etching, in which the base material is immersed in a solvent capable of dissolving resist made of resin, is preferable, due to its simplicity. The metal wires, formed in Step A5, are left on the one surface of the base material with the resist removed.

As a result of Step B5 described above, the base material 50 provided with the metal wires 30 on the one surface 50*a* is obtained, as illustrated in FIG. 2B.

As illustrated in FIG. 2C, the first rubber sheet 71A is then obtained by bonding one surface 71*a* of the first unvulcanized rubber sheet 71 onto the metal wires 30 formed on the one surface 50*a* of the base material 50, and then vulcanizing the first unvulcanized rubber sheet 71 (Step C5). As illustrated in FIG. 2D, the base material 50 is then removed by wet-etching so that the metal wires 30 are left on the one surface 71*a* of the first rubber sheet 71A (Step D5).

The steps subsequent to Step D5 may be performed in the same manner as in Steps E1 to G1 of the manufacturing method according to the first embodiment, or it is also possible to perform Steps E5 to F5 that are different, in the manner explained below.

Figure 15:
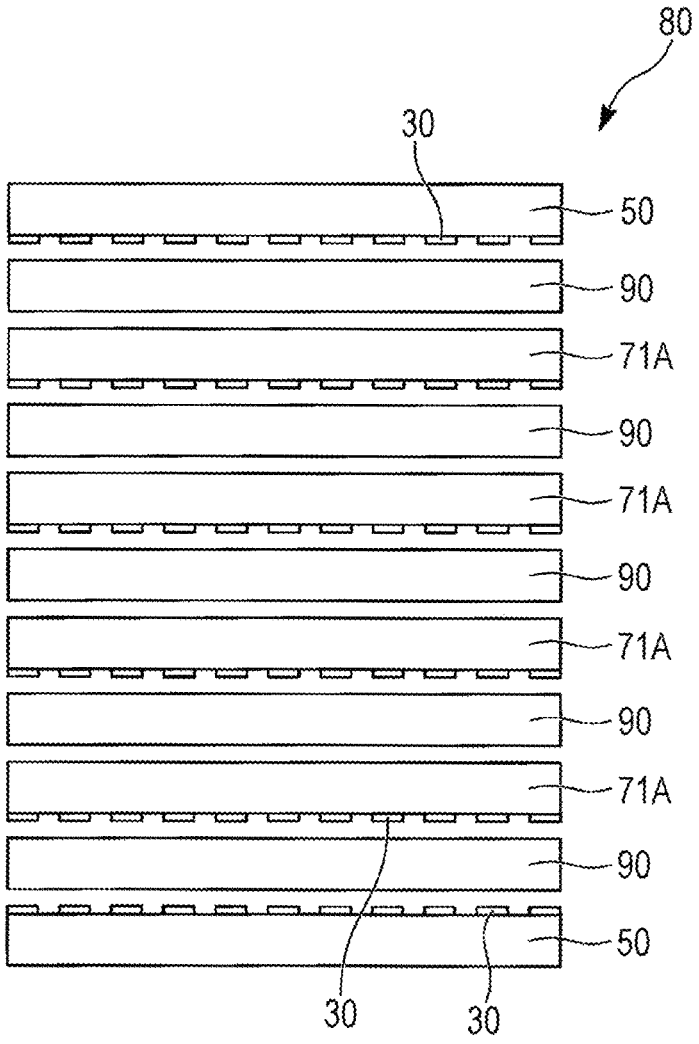
FIG. 15 is a sectional view schematically illustrating a laminate prepared by the method for manufacturing an electric connector according to Example 3 (fifth embodiment).

In the present embodiment, a plurality of rubber sheets 71A resultant of Step D5 are prepared, and a laminate 80 is formed by laminating a first rubber sheet 71A to a second rubber sheet 71A in such a manner that the one surface 71*a* of the former, where the metal wires 30 are present, faces the other side of the latter, where the metal wires 30 are not present, via the adhesive 90, as illustrated in FIG. 15 (Step E5).

In FIG. 15, the elements that are the same as those illustrated in FIGS. 1A to 3C will be given the same reference signs, and redundant explanations thereof will be omitted.

FIG. 15 illustrates an example in which the base materials 50 having the metal wires 30 are laminated on the topmost and the bottommost layers of the laminate 80, instead of the rubber sheets 71A. These layers of the base materials 50 are subsequently removed by etching, and when the metal wires 30 become exposed, an insulating later is formed on their surface by applying the adhesive 90. However, it is also possible to laminate only the rubber sheets 71A via the adhesive 90, without providing the base material 50.

As to the thickness of the adhesive 90 in the laminate 80, a thickness equivalent to that of the second unvulcanized rubber sheet 72 used in the first embodiment may be used, for example.

The adhesive 90 is vulcanized and cured as appropriate, using a publicly known method such as heating and drying, depending on the type of the adhesive 90 used.

The laminate 80 resultant of Step E5 is then cut perpendicularly to the extending direction of the metal wires 30 (that is, the depth direction with respect to the paper surface in FIG. 15) (Step F1).

In this manner, an intended electric connector (e.g., an electric connector that is the same as that illustrated FIG. 3C) is obtained.

The present embodiment is simpler than the first embodiment, because it involves no step of providing the elastic bodies 21 using the second unvulcanized silicone rubber.

With the method for manufacturing an electric connector according to the first to the fifth embodiments explained above, it is possible to obtain an electric connector 10 in which no excessive force is applied from the metal wires 30 to the connection terminal of a device to be connected to the electric connector 10, and damage of the connection terminal are prevented, and to which a small-pitched, and highly dense device can be connected. Furthermore, with the method for manufacturing an electric connector according to the first to the fifth embodiments, a small-pitched electric connector 10 provided with thin metal wires 30 can be manufactured easily.

Furthermore, the method for manufacturing an electric connector according to these embodiments may include a step of making ends of the metal wires 30 project from at least one of the one principal surface 20*a* and the other principal surface 20*b* of the electric connector 10 (projecting step).

Available as a method for making the ends of the metal wires 30 project from the principal surface is a method of scraping off a part of the resin layer making up the principal surface the electric connector 10, by performing laser etching, chemical etching, or machining such as cutting, for example.

When a plating layer is to be formed on the projecting ends of the metal wires 30, any known electroplating or electroless plating method may be used.

EXAMPLES

The present invention will now be explained more specifically using some examples and a comparative example, but the scope of the present invention is not limited to the examples described below.

Example 1

One example of the present invention will now be explained with reference to FIGS. 1A to 3C.

A gold-plated plate was prepared by applying a nickel plating layer having a thickness of 0.5 μm to the surface of a base material that is a copper plate having a thickness 50 μm, and by applying a gold plating layer having a thickness 0.5 μm to the surface of the nickel plating layer on the base material.

On one surface of the gold-plated plate, a plurality of stripe-shaped metal wires having a width of 50 μm were then formed at a pitch of 200 μm by removing the gold plating layer of the gold-plated plate, by laser-machining the gold plating layer. Used in this example was laser at a wavelength of 532 nm.

Into 100 parts by mass of a millable compound (product number: KE-174-U available from Shin-Etsu Chemical Co., Ltd.), 0.6 parts by mass of a vulcanizing agent (product number: C-19A available from Shin-Etsu Chemical Co., Ltd.), 2.5 parts by mass of another vulcanizing agent (product number: C-19B), and 1 part by mass of a silane coupling agent (product number: KBM-403 available from Shin-Etsu Chemical Co., Ltd.) were added and kneaded to obtain a first clay-like silicone rubber sheet.

This first clay-like silicone rubber sheet was then formed to a thickness of 85 μm.

One surface of the first clay-like silicone rubber sheet was then bonded onto the metal wires formed on the gold-plated plate, and the first clay-like silicone rubber sheet was heated for 40 minutes at a temperature of 135° C., to obtain a first silicone rubber sheet.

The base material was then removed, by immersing the gold-plated plate, having the metal wires formed thereon and having the first silicone rubber sheet bonded thereon, in the ferric chloride solution. In this manner, the metal wires were transferred onto the one surface of the first silicone rubber sheet.

A second clay-like silicone rubber sheet having the same structure and thickness as those of the first clay-like silicone rubber sheet was then bonded onto the one surface of the first silicone rubber sheet, in a manner covering the metal wires, and the second clay-like silicone rubber sheet was then heated and vulcanized for 40 minutes at a temperature of 135° C., to obtain the second silicone rubber sheet. In this manner, a plurality of elastic bodies were formed, each including the first silicone rubber sheet, the second silicone rubber sheet, and the metal wires interposed therebetween.

A laminate was then formed by laminating the elastic bodies, with liquid silicone rubber interposed therebetween, in such a manner that the metal wires embedded in the elastic bodies were positioned on top of one another, and in parallel with one another. In this example, liquid silicone rubber was applied on the adhesion surface of the elastic body at a thickness of 30 μm by screen printing. After the elastic bodies were laminated with liquid silicone rubber interposed therebetween, the laminate was heated and vulcanized for 40 minutes at a temperature of 135° C.

The resultant laminate was then cut perpendicularly to the extending direction of the metal wires, to obtain an electric connector having a thickness of 300 μm, just like the electric connector illustrated in FIGS. 1A and 1B.

In the electric connector in this example, the length of the short side of the rectangular shape of the metal wires on an interface was 0.5 μm, and the length of the long side of the rectangular shape of the metal wires on the interface was 0.05 mm (50 μm). The total area of the metal wires per 5 $mm^2$ of the interface was 0.003125 $mm^2$. The pitch between the metal wires in the long-side direction of the rectangular shape on the interface (corresponding to $P_2$ in FIGS. 1A and 1B) was 0.2 mm, and the pitch between the metal wires in the short-side direction of the rectangular shape on the interface (corresponding to $P_1$ in FIGS. 1A and 1B) was 0.2 mm. The interface herein is a principal surface of the electric connector, and the face to which the device is coupled (connected).

Example 2

One surface of a first clay-like silicone rubber sheet that is the same as that in Example 1 was bonded onto the gold plating layer of a gold-plated plate prepared in the same manner as in Example 1, and the first clay-like silicone rubber sheet was heated for 40 minutes at a temperature of 135° C., to obtain a first silicone rubber sheet.

The base material was then removed, by immersing the gold-plated plate having the first silicone rubber sheet bonded on the gold plating layer, in the ferric chloride solution. As a result, the gold plating layer was transferred onto the one surface of the first silicone rubber sheet.

The gold plating layer exposed on the one surface of the obtained first silicone rubber sheet was then irradiated with laser (at a wavelength of 532 nm), and machined into stripes having a width of 25 μm (corresponding to $L_2$ in FIGS. 1A and 1B), at a pitch of 50 μm (corresponding to $P_2$ in FIGS. 1A and 1B). A second clay-like silicone rubber sheet was then bonded onto the machined one surface of the first silicone rubber sheet in a manner covering the metal wires, and vulcanized, in the same manner as in Example 1, to obtain an elastic body. A vulcanized laminate was then obtained by laminating a plurality of the elastic bodies, in the same manner as in Example 1. By cutting (slicing) the laminate perpendicularly to the extending direction of the metal wires, an electric connector having a thickness of 150 μm was obtained.

In the electric connector in this example, the length of the short side of the rectangular shape of the metal wire on the interface was 0.5 μm, and the length of the long side of the rectangular shape of the metal wires on the interface was 0.025 mm (25 μm). The total area of the metal wires per 5 $mm^2$ of the interface was 0.025 $mm^2$. The pitch between the metal wires on the interface in the long-side direction of the rectangular shape (corresponding to $P_2$ in FIGS. 1A and 1B) was 0.05 mm, and the pitch between the metal wires in the short-side direction of the rectangular shape on the interface (corresponding to $P_1$ in FIGS. 1A AND 1B) was 0.05 mm. To make the pitch $P_1$ smaller than that used in Example 1, the thickness of the silicone rubber sheets and the thickness by which the liquid silicone rubber was applied were set smaller than those in Example 1.

Example 3

After a L/S resist pattern was formed on the surface of a copper plate having a thickness of 50 μm, using an ordinary method, a nickel plating layer having a thickness of 0.5 μm was formed on the surface where the copper was exposed, and a gold plating layer having a thickness of 0.5 μm was laid on top. The resist pattern was then removed, to obtain a gold-plated plate on which a plurality of stripe-shaped metal wires having a width of 10 μm were formed at a pitch of 20 μm, on the surface of the copper plate.

After bonding one surface of a first clay-like silicone rubber sheet that is the same as that in Example 1 onto the metal wires on the gold-plated plate, the first clay-like silicone rubber sheet was heated for 40 minutes at a temperature of 135° C., to obtain a first silicone rubber sheet.

The base material was then removed by immersing the gold-plated plate, having the first silicone rubber sheet bonded thereon, in the ferric chloride solution. In this manner, the metal wires were transferred onto one surface of the first silicone rubber sheet.

A plurality of the first silicone rubber sheets having the metal wires transferred thereon were prepared, and a laminate was obtained. This laminate included a gold-plated plate placed on top of a desired number of pairs of the liquid silicone rubber and the first silicone rubber sheet, with another gold-plated plate placed below the layers, via the liquid silicone rubber (see FIG. 15). In this laminate, the metal wires were arranged at equal intervals, in a manner disposed on top of one another, in a view along the laminated direction and along the planar direction of the sheet, perpendicularly intersecting with the laminated direction.

The base materials on the topmost and the bottommost surfaces of the laminate were then removed using the ferric chloride solution. A second clay-like silicone rubber sheet that is the same as that used in Example 1 was then bonded in a manner covering the exposed metal wires, and the entire laminate was then vulcanized.

The laminate was then cut (sliced) perpendicularly to the extending direction of the metal wires in the same manner as in Example 1, and an electric connector having a thickness of 150 μm was obtained.

In the electric connector in this example, the length of the short side of the rectangular shape of the metal wires on the interface was 0.5 μm, the length of the long side of the rectangular shape of the metal wires on the interface was 0.010 mm (10 μm), and the area of the metal wires per 5 $mm^2$ of the interface was 0.0625 $mm^2$. The pitch between the metal wires in the long-side direction of the rectangular shape (corresponding to $P_2$ in FIGS. 1A and 1B) on the interface was 0.020 mm, and the pitch between the metal wires in the short-side direction of the rectangular shape (corresponding to $P_1$ in FIGS. 1A and 1B) was 0.020 mm. The pitch $P_1$ was adjusted depending on the thickness by which the liquid silicone rubber was applied.

Comparative Example

A first resin layer made of silicone rubber and having a thickness of 85 μm was formed on a polyethylene-terephthalate base material, and a large number of conductive members were then arranged in parallel with one another, with an interval ensured therebetween, along the same direction, on one surface of the first resin layer.

Used as the conductive members were conductive members including a cylindrical core made of brass and having a diameter of 39.6 μm, and a nickel plating layer and a gold plating layer provided on the outer circumferential surface of the core, the nickel plating layer having a thickness of 0.1 μm, and the gold plating layer having a thickness of 0.1 μm.

A second resin layer made of silicone rubber was formed, at a thickness of 85 μm, on the one surface of the first resin layer on which a large number of conductive members were arranged. As a result, the second resin layer was integrated with the first resin layer, and the conductive members were fixed between the first resin layer and the second resin layer. In this manner, a conductive member-containing sheet was obtained.

A laminate of the conductive member-containing sheets was then formed by laminating a plurality of the conductive member-containing sheets, with the conductive members arranged in a manner facing the same direction.

The laminate was then cut, by machining, perpendicularly to the direction in which the conductive members extend, into a thickness of 300 μm, to obtain an electric connector having through holes to which the sliced conductive members were coupled.

In the electric connector in the comparative example, the diameter of the conductive members on the interface was 40 μm, and the total area of the conductive members per 5 $mm^2$ of the interface was 0.123663706 $mm^2$. The pitch between the conductive members in the long-side direction of the interface was 0.2 mm, and the pitch between the conductive members in the short-side direction of the interface was 0.25 mm.

[Evaluation 1]

Each of the electric connectors in Example 1 and the comparative example was then disposed between a probe having a copper surface applied with nickel plating and gold plating and having a diameter of 1.0 mm, and a substrate having a gold-plated connection terminal, and a laminate (tester) was obtained.

To measure the resistance between the probe and the connection terminal on the substrate, a resistance meter (product name: RM3545-01 available from HIOKI E. E. CORPORATION) was connected to the probe and the connection terminal.

In this state, the resistance was measured between the probe and the connection terminal while the laminate was compressed in the thickness direction, and a relation was examined between the amount by which the laminate was displaced (the amount of compression: the amount by which the laminate was compressed in the thickness direction) and the resistance between the probe and the connection terminal. The amount of the laminate displacement equals to the amount of the electric connector displacement.

Furthermore, as the laminate was compressed, the load imposed on the laminate was measured using an automatic load tester (product name: MAX-1KN-S-1 available from Japan Instrumentation System Co., Ltd.) to examine the relation between the amount of displacement of the laminate and the load.

Figure 10:
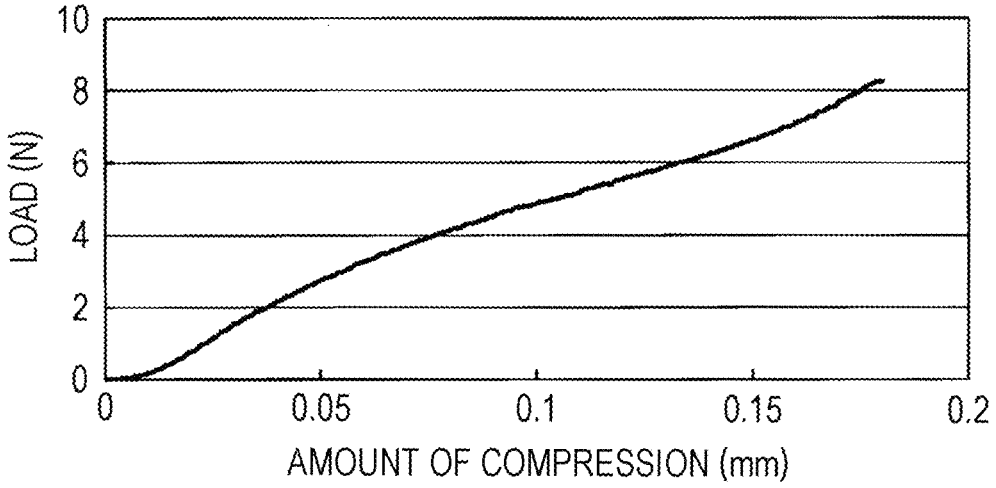
FIG. 10 is a schematic illustrating a relation between the amount of displacement (amount of compression) of a laminate, and a load applied to an electric connector, when the electric connector according to Example 1 was used.
Figure 11:
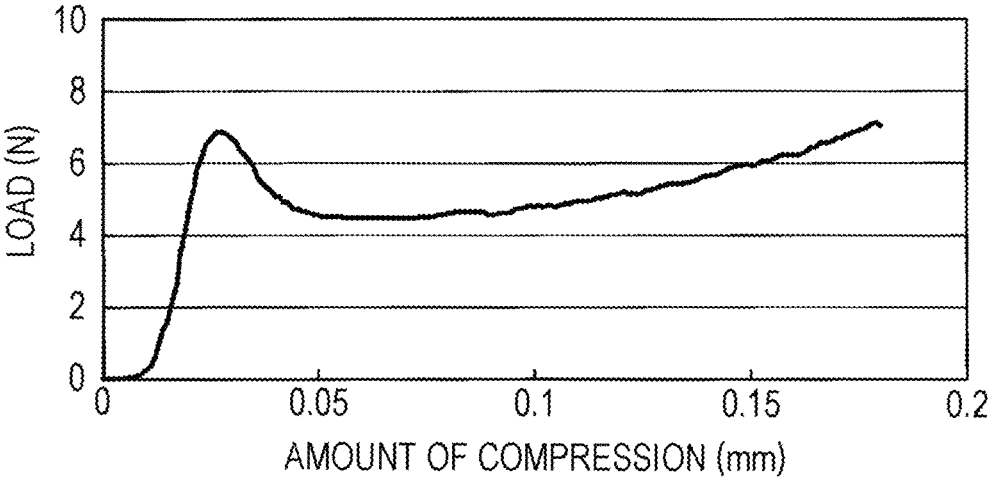
FIG. 11 is a schematic illustrating a relation between the amount of displacement (amount of compression) of the laminate, and a load applied to an electric connector, when the electric connector according to a comparative example was used.

Based on the results described above, a relation was examined between the resistance between the probe and the connection terminal of the substrate, and the load applied to the electric connector. The resultant relation between the amount of displacement of the laminate and the load, obtained with the use of the electric connector according to Example 1, is illustrated in FIG. 10. The resultant relation between the amount of displacement of the laminate and the load, obtained with the use of the electric connector in the comparative example, is illustrated in FIG. 11. The resultant relation between the amount of displacement of the laminate, and the resistance between the probe and the connection terminal, obtained with the use of the electric connector in Example 1 and the comparative example, is illustrated in FIG. 12.

Figure 12:
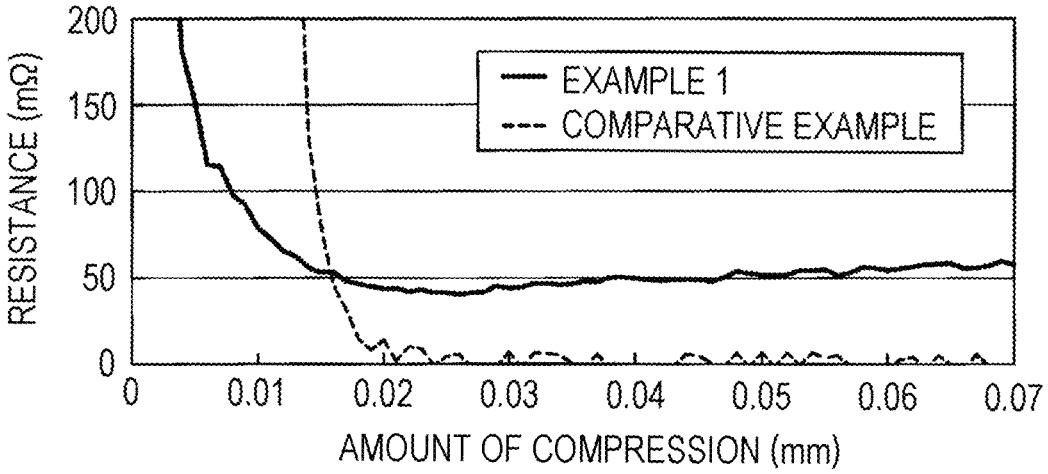
FIG. 12 is a schematic illustrating a relation between the amount of displacement (amount of compression) of the laminate, and a resistance between a probe and a connection terminal, when the electric connector according to the first embodiment or the comparative example was used.

Based on the results in FIGS. 10 to 12, the amount of compression that stabilized the resistance was 0.02 mm or so for both of Example 1 and the comparative example, and the load at the time was 0.8 N for Example 1, and 4.76 N for the comparative example. In other words, the load where the resistance was stabilized in the comparative example was more than twice that in Example 1. With Example 1, it is therefore possible to reduce the load imposed on the electrode to be inspected, and to suppress damage of the electrode.

A laminate was prepared also for the electric connectors in Example 2 and Example 3, a relation was examined between the amount of compression of the laminate (the amount of displacement) and the resistance between the probe and the connection terminal, and a relation was examined between the amount of compression of the laminate and the load, in the same manner as in Example 1.

As a result, the amount of compression that stabilized the resistance was 0.008 mm in Example 2, and was 0.005 mm in Example 3. Furthermore, the load at the time of this stabilization was 0.62 N in Example 2, and 0.3 N in Example 3.

From the results of the above examinations, in Example 2 and Example 3, because the resistance was stabilized with a smaller amount of compression, than that in Example 1, the load imposed on the electrodes to be inspected can be reduced even further, and damage of the electrodes can be reduced even further in Example 2 and Example 3.

[Evaluation 2]

Each of the electric connectors in Example 1 and the comparative example was disposed between a probe having a copper surface applied with nickel plating and gold plating and having a diameter of 1.0 mm, and a glass substrate bonded with a copper foil tape including a copper layer having a thickness of 35 μm and a conductive adhesive having a thickness of 25 μm, and a laminate (tester) was formed toward the copper layer.

In this state, the laminate was compressed in the thickness direction.

The contact surface between the electric connector and the copper foil tape was observed with a load of 8 N applied in Example 1 and the comparative example, using a scanning electron microscope. The scanning electron microscope image in Example 1 is illustrated in FIG. 13, and the scanning electron microscope image in the comparative example is illustrated in FIG. 14.

Figure 13:
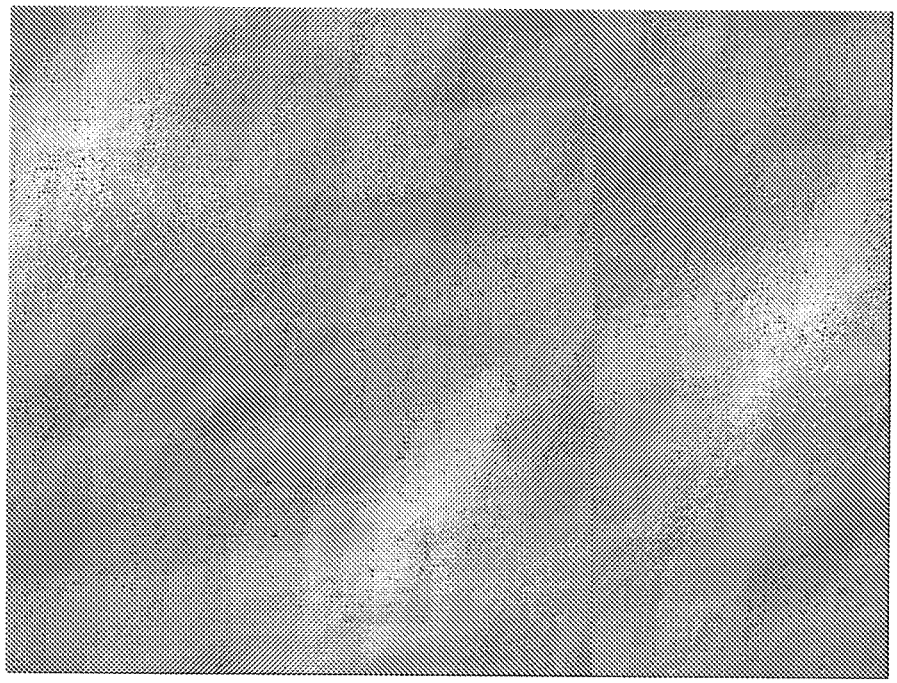
FIG. 13 is a scanning electron microscope image of a contact surface between the electric connector and a copper foil tape in Example 1.
Figure 14:
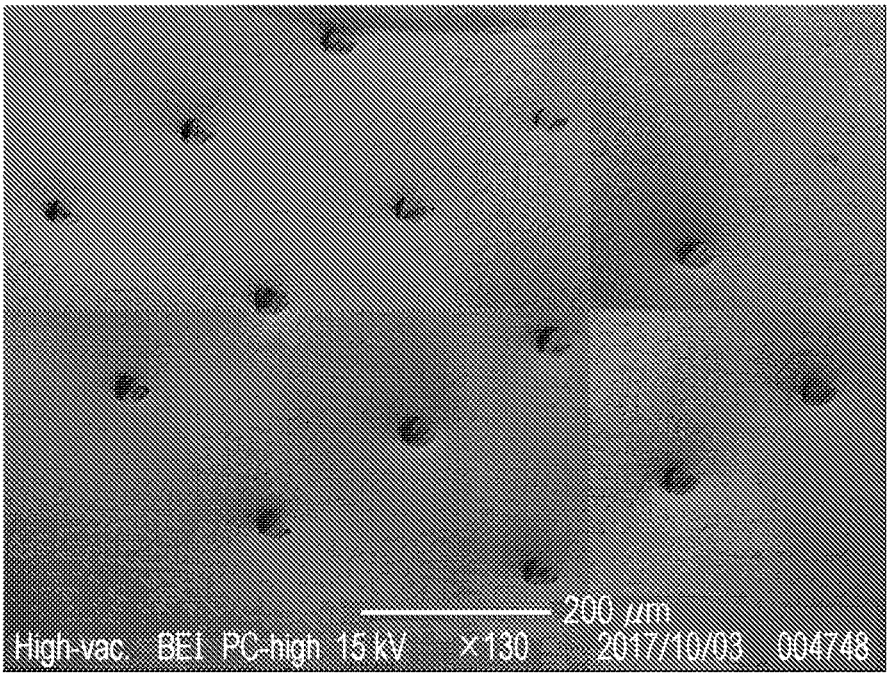
FIG. 14 is a scanning electron microscope image of a contact surface between the electric connector and a copper foil tape in the comparative example.

In Example 1, there was no observable damage caused by the metal wires of the electric connector on the copper foil tape, based on the result illustrated in FIG. 13. By contrast, in the comparative example, there was observable damage caused by the metal wires of the electric connector on the copper foil tape, based on the result illustrated in FIG. 14.

The electric connectors in Example 2 and Example 3 were also brought into contact with the copper foil tape while the laminate was compressed, in the same manner as in Example 1. The contact surface was then observed using a scanning electron microscope, and there was no damage caused by the conductive members of these electric connectors.

[Evaluation 3]

Using the electric connectors in Example 2 and Example 3, a laminate (tester) that was the same as that in Evaluation 1, except that the probe in Evaluation 1 was replaced with a probe having a diameter of 0.14 mm, was formed and connected with a resistance meter and an automatic load tester, in the same manner as in Evaluation 1.

In this state, the resistance was measured between the probe and the connection terminal, while the laminate was compressed in the thickness direction, and a relation was examined between the amount of compression of the laminate (the amount of displacement) and the resistance between the probe and the connection terminal. The measurement continued until the load applied to the laminate reached 0.15 N, and a relation was examined between the amount of compression of the laminate and the load.

Figure 16:
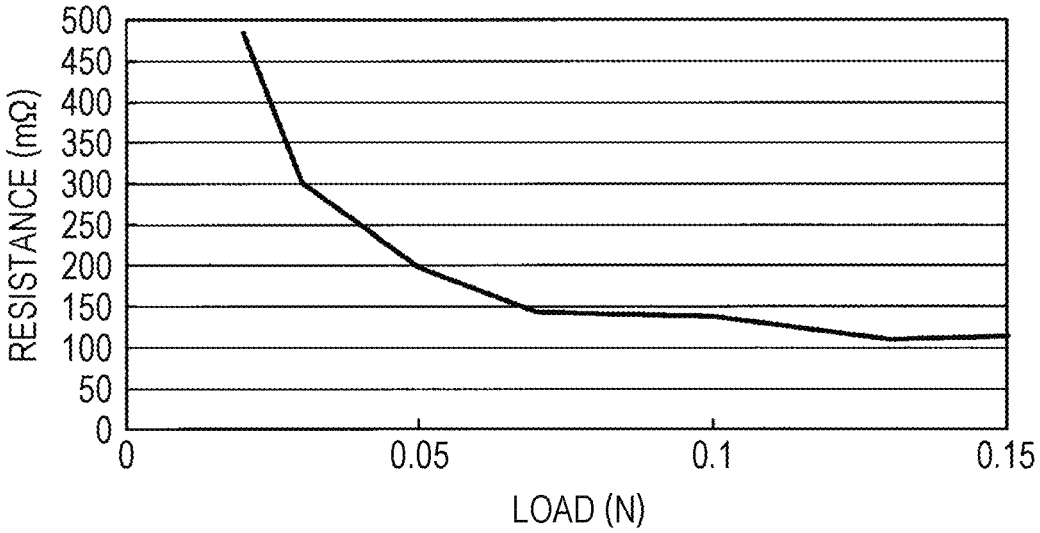
FIG. 16 is a schematic illustrating a relation between a load applied to an electric connector and the resistance between the probe and the connection terminal, when the electric connector according to Example 2 was used.
Figure 17:
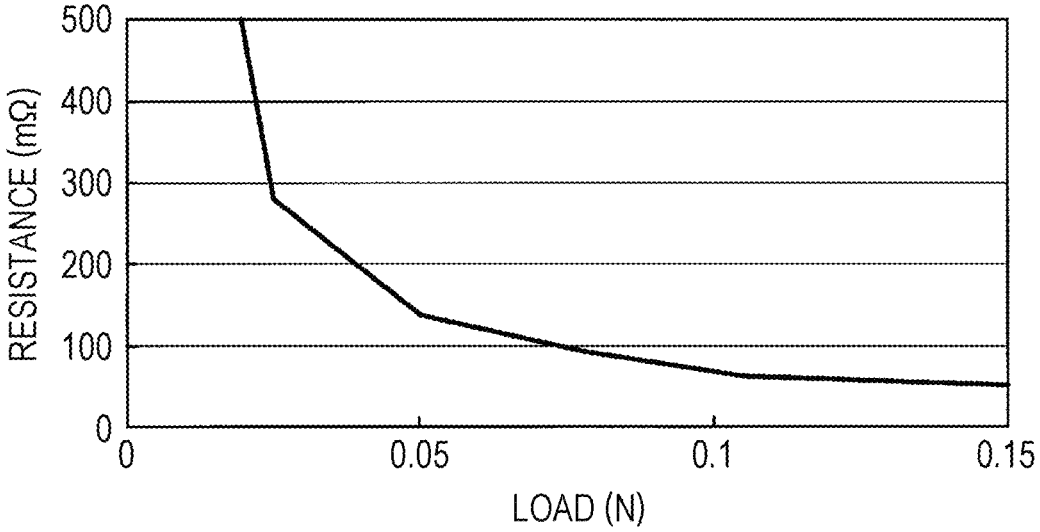
FIG. 17 is a schematic illustrating a relation between a load applied to an electric connector and the resistance between the probe and the connection terminal, when the electric connector according to Example 3 was used.
Figure 18:
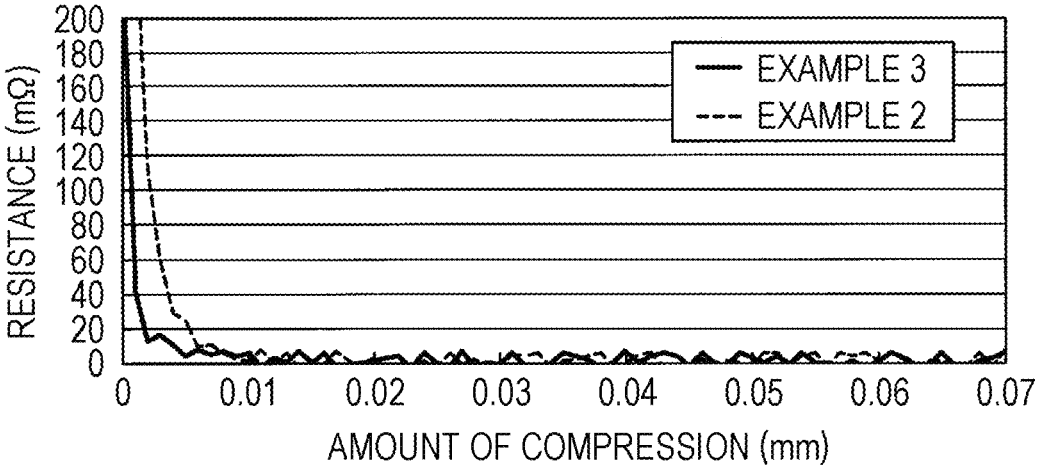
FIG. 18 is a schematic illustrating a relation between the amount of compression of the laminate and the resistance between the probe and the connection terminal, when the electric connector according to Example 2 or Example 3 was used.
Figure 19:
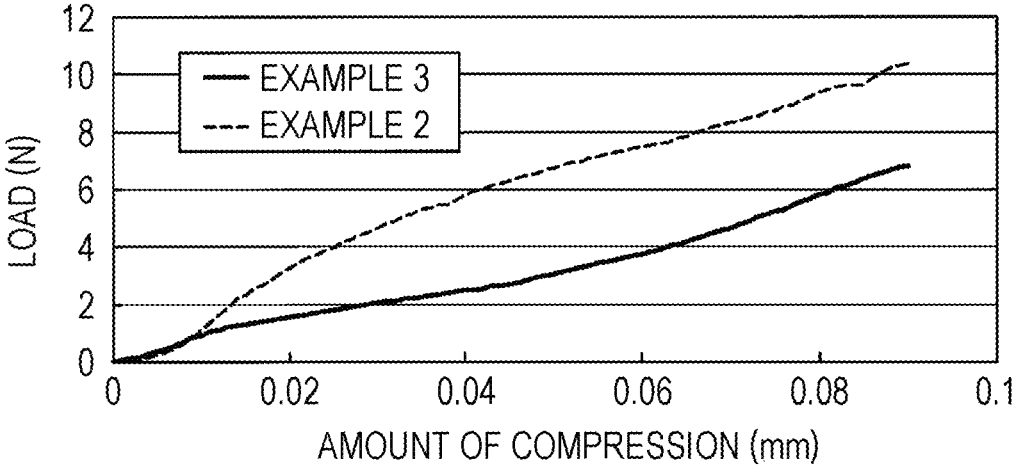
FIG. 19 is a schematic illustrating a relation between the amount of compression of the laminate and the load applied to the electric connector, when the electric connector according to Example 2 or Example 3 was used.

Based on the results of these examinations, a relation was examined between the resistance between the probe and the connection terminal of the substrate, and the load applied to the electric connector. The resultant relation of the resistance between the probe and the connection terminal with respect to the load applied to the laminate, obtained with the use of the electric connector in Example 2, is illustrated in FIG. 16. The resultant relation of the resistance between the probe and the connection terminal with respect to the load applied to the laminate, obtained with the use of the electric connector in Example 3, is illustrated in FIG. 17. The resultant relation of the amount of compression of the laminate with respect to the resistance between the probe and the connection terminal, obtained with the use of the electric connector in Example 2 or Example 3, is illustrated in FIG. 18. The resultant relation of the amount of compression of the laminate with respect to the load applied to the laminate, obtained with the use of the electric connector in Example 2 or Example 3, is illustrated in FIG. 19.

In Example 2 and Example 3, because the electrodes to be inspected can be connected stably with a smaller compressive load than that in Example 1, on the basis of the results illustrated in FIGS. 16 to 19, it is clear that the load imposed on the electrodes to be inspected can be reduced even further, and damage of the electrodes can be suppressed even further.

In the electric connector according to Example 1, because the pitch between the metal wires was extremely wide, with respect to the probe having a diameter of 0.14 mm, it took a lot of time and effort to bring the probe into contact with the metal wires of the electric connector according to Example 1. Measurements thus failed using the probe with a diameter of 0.14 mm from the electric connectors in Example 1 and the comparative example.

The invention claimed is:

1. An electric connector that is disposed between a connection terminal of a first device and a connection terminal of a second device, and is configured to electrically connect the connection terminals, the electric connector comprising:

a resin layer; and a plurality of metal wires extending through the resin layer in a thickness direction, and each having a rectangular shape on surfaces to be connected to the connection terminals, wherein at least first sides of the rectangular shapes of the plurality of metal wires are arranged at equal intervals along a same direction, and short sides of the rectangular shapes have a length of equal to or more than 0.01 μm and less than 0.5 μm, and long sides of the rectangular shapes have a length of equal to or more than 0.1 μm and less than 10 μm, and ratio $L_1/L_2$ of the length $L_1$ of the short sides of the rectangular shapes with respect to the length $L_2$ of the long sides of the rectangular shapes is 0.001 to 0.7.

2. The electric connector according to claim 1, wherein the plurality of metal wires have a pitch, in a long-side direction of the rectangular shapes, of equal to or less than 0.2 mm.

3. The electric connector according to claim 1, wherein the plurality of metal wires have a pitch, in a short-side direction of the rectangular shapes, of equal to or less than 0.2 mm.

4. The electric connector according to claim 1, wherein the plurality of metal wires extend through the resin layer diagonally with respect to the thickness direction.

5. The electric connector according to claim 1, wherein ends of the plurality of metal wires project from at least one of one principal surface and another principal surface of the resin layer.

6. The electric connector according to claim 1, wherein a plating layer is formed on ends of the plurality of metal wires.

* * * * *